US009671705B2

(12) United States Patent
Kitagawa et al.

(10) Patent No.: US 9,671,705 B2
(45) **Date of Patent: *Jun. 6, 2017**

(54) ELECTROPHOTOGRAPHIC PHOTOCONDUCTOR, PRODUCTION METHOD THEREOF, AND ELECTROPHOTOGRAPHIC APPARATUS

(71) Applicant: FUJI ELECTRIC CO., LTD., Kawasaki-shi (JP)

(72) Inventors: Seizo Kitagawa, Matsumoto (JP); Shinjiro Suzuki, Matsumoto (JP); Hiroshi Emori, Matsumoto (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/822,772

(22) Filed: Aug. 10, 2015

(65) Prior Publication Data

US 2015/0346619 A1 Dec. 3, 2015

Related U.S. Application Data

(63) Continuation of application No. PCT/JP2014/068630, filed on Jul. 11, 2014.

(30) Foreign Application Priority Data

Jul. 16, 2013 (JP) ..... PCT/JP2013/069253

(51) Int. Cl.
*G03G 5/00* (2006.01)
*G03G 5/10* (2006.01)
(Continued)

(52) U.S. Cl.
CPC ..... *G03G 5/10* (2013.01); *G03G 5/0517* (2013.01); *G03G 5/0521* (2013.01);
(Continued)

(58) Field of Classification Search
CPC ..... G03G 5/14708; G03G 5/14713; G03G 5/14721
(Continued)

(56) References Cited

U.S. PATENT DOCUMENTS 4,792,507 A 12/1988 Yoshihara et al.
4,882,253 A 11/1989 Kato et al.
(Continued)

FOREIGN PATENT DOCUMENTS

JP H03-256050 A 11/1991
JP H04-241359 A 8/1992
(Continued)

OTHER PUBLICATIONS

International Search Report received in PCT/JP2013/069253 on Jul. 16, 2013.
(Continued)

*Primary Examiner* — Mark A Chapman
(74) *Attorney, Agent, or Firm* — Rabin & Berdo, P.C.

(57) ABSTRACT

An electrophotographic photoconductor includes a conductive support; and a photoconductive layer that contains at least a charge generation material, a hole transport material, an electron transport material and a binder resin, and that is provided on the conductive support, wherein the photoconductive layer has an outermost layer that contains a charge generation material, a hole transport material, an electron transport material, a binder resin and a highly branched polymer that is obtained by polymerizing, in the presence of a polymerization initiator, a monomer having, in a molecule, two or more radically polymerizable double bonds and a monomer having, in a molecule, a long-chain alkyl group or an alicyclic group and at least one radically polymerizable double bond. The electrophotographic photoconductor exhibits superior operational stability and stably high image
(Continued)

quality, without problems with image memory, a contact member, or image defects due to cracks caused by contamination by oils/fats or sebum.

15 Claims, 2 Drawing Sheets

(51) Int. Cl.
*G03G 5/06* (2006.01)
*G03G 5/05* (2006.01)
*G03G 5/147* (2006.01)

(52) U.S. Cl.
CPC ..... *G03G 5/0564* (2013.01); *G03G 5/0592* (2013.01); *G03G 5/0609* (2013.01); *G03G 5/0614* (2013.01); *G03G 5/0618* (2013.01); *G03G 5/0696* (2013.01); *G03G 5/14708* (2013.01); *G03G 5/14713* (2013.01); *G03G 5/14721* (2013.01); *G03G 5/14791* (2013.01)

(58) Field of Classification Search
USPC ..... 430/66
See application file for complete search history.

(56) References Cited

U.S. PATENT DOCUMENTS

| | | | |
|---|---|---|---|
| 5,324,610 | A | 6/1994 | Tanaka et al. |
| 2011/0091799 | A1 | 4/2011 | Nakamura et al. |
| 2012/0003574 | A1 | 1/2012 | Kitagawa et al. |
| 2014/0088216 | A1 | 3/2014 | Matsuyama et al. |

FOREIGN PATENT DOCUMENTS

| | | | |
|---|---|---|---|
| JP | H04-242259 | A | 8/1992 |
| JP | H05-12702 | B2 | 2/1993 |
| JP | H05-45915 | A | 2/1993 |
| JP | H05-30262 | B2 | 5/1993 |
| JP | H05-47822 | B2 | 7/1993 |
| JP | H07-160017 | A | 6/1995 |
| JP | 2001-353808 | A | 12/2001 |
| JP | 2003-228184 | A | 8/2003 |
| JP | 2003-255580 | A | 9/2003 |
| JP | 2006-047344 | A | 2/2006 |
| JP | 2006-106772 | A | 4/2006 |
| JP | 2007-121733 | A | 5/2007 |
| JP | 2007-163523 | A | 6/2007 |
| JP | 2007-256768 | A | 10/2007 |
| JP | 2009-288569 | A | 12/2009 |
| JP | 2010-024330 | A | 2/2010 |
| JP | 2010-276699 | A | 12/2010 |
| JP | 2011-064734 | A | 3/2011 |
| JP | 2011203495 | A | 10/2011 |
| JP | 2012-093403 | A | 5/2012 |
| JP | 2013050559 | A | 3/2013 |
| JP | 2013057904 | A | 3/2013 |
| WO | WO-2009/104571 | A1 | 8/2009 |
| WO | WO-2012/128214 | A1 | 9/2012 |

OTHER PUBLICATIONS

Office Action received in corresponding Japanese Patent Application No. 2015-527283 on Aug. 2, 2016.

ELECTROPHOTOGRAPHIC PHOTOCONDUCTOR, PRODUCTION METHOD THEREOF, AND ELECTROPHOTOGRAPHIC APPARATUS

CROSS-REFERENCE TO RELATED APPLICATIONS

This non-provisional application for U.S. Letters Patent is a Continuation of International Application PCT/JP2014/068630 filed Jul. 11, 2014, which claims priority from International Application PCT/JP2013/069253 filed Jul. 16, 2013, the entire contents of both of which are hereby incorporated by reference.

BACKGROUND OF THE INVENTION

1. Field of the Invention

The present invention relates to an electrophotographic photoconductor (hereafter also referred to simply as "photoconductor"), to a method for producing the electrophotographic photoconductor, and to an electrophotographic apparatus. More particularly, the present invention relates to an electrophotographic photoconductor that is used in electrophotographic printers, copiers, fax machines and the like, to a method for producing the electrophotographic photoconductor, and to an electrophotographic apparatus.

2. Background of the Related Art

Generally, image forming apparatuses that rely on electrophotographic schemes, for instance printers, copiers, fax machines and the like, are provided with a photoconductor as an image carrier, a charging device that charges homogeneously the surface of the photoconductor, an exposure device that draws, on the surface of the photoconductor, an electrical image (electrostatic latent image) according to an image, a developing device that develops, with toner, the electrostatic latent image, to form thereby a toner image, and a transfer device that transfers the toner image to transfer paper. The electrophotographic apparatus is also provided with a fixing device for fusing, onto the transfer paper, the toner that has been transferred thereonto.

The photoconductors that are used on such image forming apparatuses vary depending on the concept of the apparatus. However, with the exception of inorganic photoconductors such as Se or a-Si, in large machines and high-speed machines, organic photoconductors (OPCs) in which an organic pigment is dispersed in a resin are widely used at present on account of their superior stability, cost and ease of use. These organic photoconductors are generally of negatively chargeable type, unlike inorganic photoconductor which are of positively chargeable type. One reason for this is that development of hole transport materials that afford a good hole transport function, in negatively-chargeable organic photoconductors, has been going on for a long time, whereas few electron transport materials having good electron transport capability have been developed in positively-chargeable organic photoconductors.

The negative charging process in negatively-chargeable organic photoconductors is problematic in that the amount of ozone generated due to negative-polarity corona discharge is far larger, about ten times, than that of positive polarity. This has an adverse effect on the photoconductor and on the usage environment. Accordingly, the ozone generation amount is curtailed by resorting to a contact charging scheme, such as roller charging or brush charging in the negative charging process. However, contact charging schemes have drawbacks, for instance, in being disadvantageous in terms of cost, as compared with positive-polarity contactless charging schemes, and also in terms of entailing unavoidable contamination of a charging member, and insufficient reliability. Contact charging schemes have also drawbacks when it comes to affording high image quality, since, for instance, it is difficult to achieve homogeneous surface potential in the photoconductor.

In order to solve these problems, high-performance positively-chargeable organic photoconductors are required that can be used effectively. Other advantages of positively-chargeable organic photoconductors, besides those that are inherent to positive charging schemes, as described above, include less transverse diffusion of carriers than in the case of negatively-chargeable organic photoconductors, and thus superior dot reproducibility (resolution and gradation properties), since the carrier generation position is generally close to the surface of a photoconductive layer. Accordingly, positively-chargeable organic photoconductors are being studied in fields where ever higher resolutions are sought after.

Positively-chargeable organic photoconductors have roughly four types of layer configuration, as described below, for which various conventional configurations have been proposed. The first configuration is that of a function-separated photoconductor having a two-layer configuration in which a charge transport layer and a charge generation layer are stacked, in this order, on a conductive support, see, for instance, Japanese Examined Patent Publication H05-30262 (Patent literature 1) and Japanese Patent Application Publication No. H04-242259 (Patent literature 2). A second configuration is that of a function-separated photoconductor having a three-layer configuration in which a surface protective layer is stacked on the above two-layer configuration, see, for instance, Japanese Examined Patent Publication H05-47822 (Patent literature 3), Japanese Examined Patent Publication H05-12702 (Patent literature 4), and Japanese Patent Application Publication No. H04-241359 (Patent literature 5). A third configuration is that of a function-separated photoconductor having a two-layer configuration, reverse to that of the first configuration, i.e. a configuration in which a charge generation layer and a charge (electron) transport layer are reversely stacked, in this order, see, for instance, Japanese Patent Application Publication No. H05-45915 (Patent literature 6) and Japanese Patent Application Publication No. H07-160017 (Patent literature 7). A fourth configuration is that of a single layer-type photoconductor in which a charge generation material, a hole transport material and an electron transport material are dispersed in one same layer, see, for instance, Patent literature 6 and Japanese Patent Application Publication No. H03-256050 (Patent literature 8). The above classification into four types does not take into account the presence or absence of an undercoat layer.

Among the foregoing, the fourth type, i.e., single layer-type photoconductors, is the object of detailed study, while the scope of practical use thereof is ever wider. A major conceivable reason for this is that single layer-type photoconductors have a configuration wherein the electron transport function of an electron transport material, which is inferior in transport capability to the hole transport function of a hole transport material, is complemented by the hole transport material. Although carriers are also generated inside the film of such a single layer-type photoconductor, since the latter is of dispersed type, the carrier generation amount increases, and the electron transport distance decreases with respect to the hole transport distance, with increasing proximity to the vicinity of the surface of the photoconductive layer. Accordingly, it is deemed that the electron transport capability need not be as high as the hole transport capability. Single layer-type photoconductors afford as a result sufficient environmental stability and fatigue characteristic in practice, as compared with photoconductors of the other three types.

In single layer-type photoconductors, one single film fulfils both the functions of carrier generation and carrier transport, and, accordingly, single layer-type photoconductors are advantageous in terms of making it possible to simplify the coating process and affording a high yield rate and process capability. On the other hand, however, single layer-type photoconductors have been problematic on account of reduced content of binder resin, and reduced durability, as a result of increasing, within one same layer, both the amount of hole transport material and electron transport material in order to enhance sensitivity and speed. In consequence, single layer-type photoconductors have limitations in terms of combining both high sensitivity and high speed with high durability.

A further drawback of single layer-type photoconductors has been the drop in glass transition point, and poorer contamination resistance towards a contact member, when the ratio of binder resin is reduced.

The drop in the glass transition point is further exacerbated when a plasticizer in the form of a phenylene compound is added to into the photoconductive layer of single layer-type photoconductor, as a countermeasure against contamination by oils/fats and sebum, as described in Japanese Patent Application Publication No. 2007-163523 (Patent literature 9), Japanese Patent Application Publication No. 2007-256768 (Patent literature 10), and Japanese Patent Application Publication No. 2007-121733 (Patent literature 11). This has resulted in problems of significant creep deformation, and manifestation of printing defects, in equipment with high contact pressure of rollers or the like that are in contact with organic photoconductors.

It is thus difficult to achieve concurrently sensitivity, durability, and contamination resistance, by using conventional single layer-type positively-chargeable organic photoconductors, in coping with ever smaller sizes, higher speeds, higher resolutions and colorization in equipment in recent years. Thus novel multilayer-type positively-chargeable photoconductors have been proposed that are a sequential stack of a charge transport layer and a charge generation layer, see, for instance, Japanese Patent Application Publication No. 2009-288569 (Patent literature 12) and WO 2009/104571 (Patent literature 13). The layer configuration of multilayer-type positively-chargeable photoconductors is similar to the layer configuration of the above-described first type, but herein the amount of charge generation material comprised in the charge generation layer is reduced, the electron transport material is incorporated, the thickness of the photoconductor can be brought close to that of the low-layer charge transport layer, and, moreover, the addition amount of hole transport material inside the charge generation layer can be reduced. It becomes accordingly possible to set a higher resin ratio within the charge generation layer than in the case of conventional single layer-type photoconductors, and to achieve both higher sensitivity and higher durability.

However, the durability against sebum contamination in both the multilayer-type positively-chargeable organic photoconductors and single layer-type photoconductors is not necessarily sufficient, and surface cracks, as well as image defects such as white spots and black spots occur in some instances when human nose fat, or scalp sebum, remains adhered to the surface of the photoconductor over long periods of time.

Known conventional technologies pertaining to improvements in photoconductors include, in addition to those above, also a technology that involves using polymer microparticles in the form of microspheres, of core-shell type, that have, on the outer peripheral section, a functional layer made up of functional groups having a charge generation function, and in the interior, an adsorption layer having enough charge as to enable adsorption on account of electrostatic interactions Japanese Patent Application Publication No. 2003-228184 (Patent literature 14), and a technology that involves using a cured product of an oligomer with a radically polymerizable compound having a charge-transporting structural moiety, wherein the oligomer has a hyperbranched structure or a dendrimer structure having at least an acryloyloxy group or a methacryloyloxy group at the termini, see Japanese Patent Application Publication No. 2010-276699 (Patent literature 15). Further known technologies include a technology that involves incorporating, into the surface layer of a photoconductor, a binder resin and a linear vinyl polymer having long-chain alkyl groups in side chains, see Japanese Patent Application Publication No. 2003-255580 (Patent literature 16), and a technology that involves enhancing crosslinking and surface lubricity of a protective layer of a photoconductor, by using, as the protective layer, a layer made up of a cured resin that is obtained by polymerizing a radically polymerizable monomer in the presence of a mercapto-modified silicone oil, see Japanese Patent Application Publication No. 2012-93403 (Patent literature 17).

As described above, although it is possible to achieve resistance towards contamination by oils/fats such as grease, concurrently with high sensitivity/high-speed combined with high durability, both in positively-chargeable organic photoconductors of single layer type and in positively-chargeable organic photoconductors of multilayer type, such as those disclosed in Patent literature 12 and 13, no photoconductor has been heretofore capable of preventing completely the occurrence of image defects derived from contamination i.e. derived from the occurrence of cracks by human sebum adhesion.

Therefore, it is an object of the present invention to solve the above problems by providing an electrophotographic photoconductor of high sensitivity and fast response, as well as high durability, that is used in high-resolution, high-speed electrophotographic apparatuses of positive charging schemes, such that the electrophotographic photoconductor boasts superior operational stability and affords stably high image quality, without the occurrence of problems with image memory, a contact member, or image defects due to cracks caused by contamination by oils/fats or sebum, and to provide a method for producing the electrophotographic photoconductor, and an electrophotographic apparatus.

SUMMARY OF THE INVENTION

As a result of diligent research on measures for preventing cracks derived from sebum, the inventors found that by dissolving, in the coating solution of an outermost layer, a highly branched polymer of specific structure, and by applying the outermost layer in a state where the highly branched polymer is dispersed in the coating solution, it becomes possible to incorporate the highly branched polymer into the outermost layer, and as a result, to elicit diffusion, in the horizontal direction, of oil oozing from human sebum, so that the occurrence of cracks derived from sebum can be prevented thereby.

In many instances, sebum exhibits discoloration at portions where cracks have occurred, after ten days with sebum adhered to the surface of the photoconductor. It is found that the charge transport material that elutes in oil from sebum migrates readily in the direction of sebum on the surface of the photoconductor. Specifically, the following mechanism is presumably involved.

When residual solvent of the photoconductive layer is present in the film, the hole transport material, or decomposition products thereof, having eluted in oils oozing from sebum migrate readily in the direction of sebum on the film surface. It is deemed that, thereafter, voids in the film become yet larger due to migration of the electron transport material, whereupon stress concentrates in these enlarged voids, giving rise to cracks.

Therefore, conceivable measures against crack occurrence involve for instance, firstly, suppressing permeation of oil from sebum into the film; secondly, using a charge transport material that is not readily eluted or broken down by oils; thirdly, adding an agent that hinders migration of the charge transport material or decomposition products thereof; and fourthly, producing a film that exhibits as little residual stress as possible.

As a result of further studies taking the above points into consideration, the inventors perfected the present invention on the basis of the idea whereby an effective countermeasure should bring out, as much as possible, the intrinsic characteristics of photoconductors, specifically, that it would be effective to elicit segregation, at an outermost layer surface, of a material such that permeation of oil from sebum into the film is suppressed, as the first countermeasure, and such that migration of the charge transport material or decomposition products thereof into sebum is hindered, as the third countermeasure, to the extent that electric characteristics and quality of appearance are not compromised.

Specifically, the electrophotographic photoconductor of the present invention is an electrophotographic photoconductor comprising a conductive support; and a photoconductive layer that contains at least a charge generation material, a hole transport material, an electron transport material and a binder resin, on the conductive support, wherein an outermost layer contains a charge generation material, a hole transport material, an electron transport material, a binder resin and a highly branched polymer that is obtained by polymerizing, in the presence of a polymerization initiator, a monomer having, in the molecule, two or more radically polymerizable double bonds and a monomer having, in the molecule, a long-chain alkyl group or an alicyclic group and at least one radically polymerizable double bond.

In the present invention, a lipophilic highly branched polymer obtained through introduction of a long-chain alkyl group or an alicyclic group into a highly branched polymer is added, as a modifier, to the outermost layer of the photoconductor, and is caused to segregate at the outermost layer, so that, as a result, it becomes possible to hinder intrusion of oils and migration of materials.

A branched structure is actively introduced into the highly branched polymer, and hence the highly branched polymer exhibits characteristically a lower degree of molecule entanglement than linear polymers, and exhibits a microparticle-like behavior, with high dispersibility in resins. Specifically, such a highly branched polymer can be obtained by polymerizing, in the presence of an azo-based polymerization initiator (C), a monomer (A) having, in the molecule, two or more radically polymerizable double bonds, and a monomer (B) having, the molecule, an alkyl group having 6 to 30 carbon atoms or an alicyclic group having 3 to 30 carbon atoms, and at least one radically polymerizable double bond.

Application examples of the highly branched polymer in electrophotographic photoconductors include the technology described in Patent literature 14, which proposes the addition of the highly branched polymer to a charge generation layer to enhance thereby a charge generation function, or the technology described in Patent literature 15, which proposes adding a highly branched polymer to a surface protective layer, to enhance as a result wear resistance. The foregoing, however, differ from the present invention as regards structure and effect. In the present invention, a highly branched polymer of specific structure is caused to segregate at an outermost surface layer, to cause human oils to diffuse in the horizontal direction, and prevent intrusion of the oils into the photoconductor.

By virtue of the above features, the present invention succeeds in realizing an electrophotographic photoconductor of high sensitivity and fast response, as well as high durability, that is used in high-resolution, high-speed electrophotographic apparatuses of positive charging schemes, such that the electrophotographic photoconductor boasts superior operational stability and affords stably high image quality, without the occurrence of image memory or image defects due to cracks caused by contamination by a contact member, oils/fats or sebum, and succeeds in realizing a method for producing the electrophotographic photoconductor, and an electrophotographic apparatus.

DETAILED DESCRIPTION OF THE INVENTION

Embodiments of the present invention will be explained next in detail with reference to accompanying drawings. The present invention is not limited in any way to the explanation below.

Figure 1:
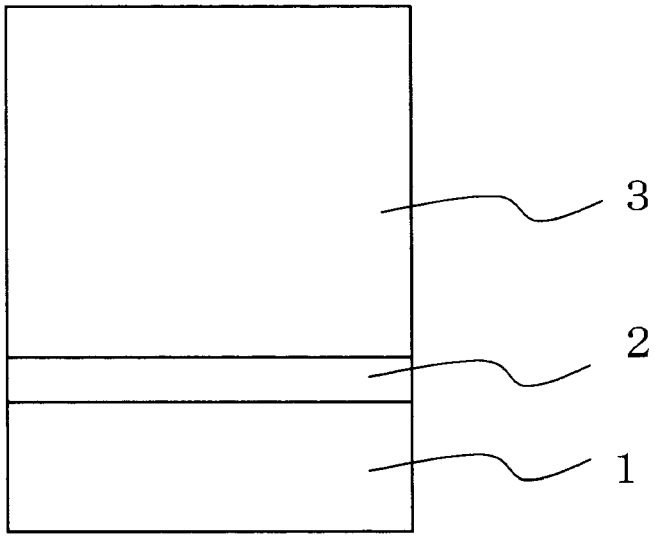
FIG. 1 is a schematic cross-sectional diagram illustrating a configuration example of a single layer-type positively-chargeable photoconductor of the present invention.
Figure 2:
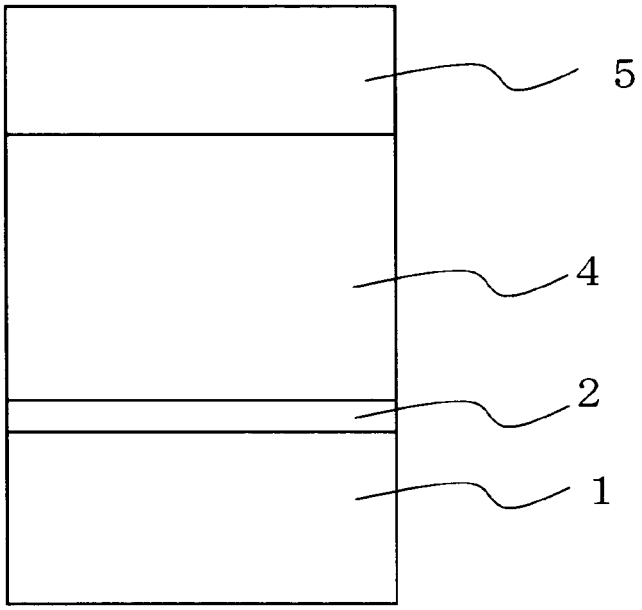
FIG. 2 is a schematic cross-sectional diagram illustrating a configuration example of a multilayer-type positively-chargeable photoconductor of the present invention.

FIG. 1 and FIG. 2 are cross-sectional diagrams illustrating a configuration example of an electrophotographic photoconductor of the present invention. FIG. 1 illustrates a configuration wherein a photoconductive layer 3 of single layer type is stacked on a conductive support 1 via an undercoat layer 2. FIG. 2 illustrates a configuration wherein a charge transport layer 4 and a charge generation layer 5 are stacked, in this order, on a conductive support 1, via an undercoat layer 2. The undercoat layer 2 is not fundamentally necessary in the present invention, but may be provided as needed, as illustrated in the figures.

The electrophotographic photoconductor of the present invention illustrated in the figures is a positively-chargeable electrophotographic photoconductor that contains, in an outermost layer, a charge generation material, a hole transport material and an electron transport material, and a binder resin, and, in addition, a highly branched polymer that is obtained by polymerizing, in the presence of a polymerization initiator, a monomer having, in the molecule, two or more radically polymerizable double bonds, and a monomer having, in the molecule, a long-chain alkyl group or an alicyclic group and at least one radically polymerizable double bond. In the present invention, a highly branched polymer having introduced thereinto a long-chain alkyl group or an alicyclic group of specific molecular weight, is incorporated, through dissolution, into a coating solution of a photoconductive layer or a charge generation layer, being the outermost layer of a photoconductor. Occurrence of cracks due to sebum is prevented as a result. As described above, the highly branched polymer that is used in the present invention has high dispersibility in resins, and has alicyclic groups. Accordingly, the highly branched polymer is highly lipophilic. In consequence, by being incorporated into the outermost layer of the photoconductor, the highly branched polymer segregates as a result at the photoconductor surface, binds to human sebum that is adhered to the surface, and causes the sebum to diffuse in the surface direction. Localized sebum is prevented as a result from intruding into the photoconductor, and it becomes possible thereby to hinder migration of the charge transport material and so forth into the sebum. The occurrence of cracks derived from adhesion of sebum can be prevented as a result. The highly branched polymer according to the present invention does not impair the intrinsic electrical characteristics or quality of appearance of the photoconductor.

In the present invention, it suffices that the highly branched polymer be incorporated into a single-layer photoconductive layer or stacked charge generation layer, being the outermost layer of a positively-chargeable photoconductor. The intended effect of the present invention can be achieved as a result. In the present invention, the presence or absence of other layers, specifically an undercoat layer, is not particularly limited, and can be appropriately determined as desired.

Specific examples of the monomer (A) being a structural unit of the above highly branched polymer include, for instance, the monomer represented by formula (1) below, and specific examples of the monomer (B) include, for instance, the monomer represented by formula (2) below. The highly branched polymer according to the present invention, however, is not limited to the structures depicted herein.

(1)

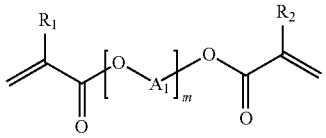

In Formula (1), $R_1$ and $R_2$ represent a hydrogen atom or a methyl group, $A_1$ represents an alicyclic group having 3 to 30 carbon atoms, or an alkylene group having 2 to 12 carbon atoms and optionally substituted with a hydroxy group, and m represents an integer ranging from 1 to 30.

(2)

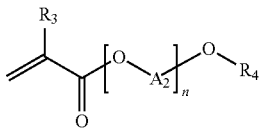

In Formula (2), $R_3$ represents a hydrogen atom or a methyl group, $R_4$ represents an alkyl group having 6 to 30 carbon atoms or an alicyclic group having 3 to 30 carbon atoms, $A_2$ represents an alkylene group having 2 to 6 carbon atoms, and n represents an integer ranging from 0 to 30.

Examples of the alkylene group having 2 to 12 carbon atoms and optionally substituted with a hydroxy group, represented by $A_1$ in Formula (1) above, include, for instance, ethylene groups, trimethylene groups, 2-hydroxytrimethylene groups, methyl ethylene groups, tetramethylene groups, 1-methyl trimethylene groups, pentamethylene groups, 2,2-dimethyl trimethylene groups, hexamethylene groups, nonamethylene groups, 2-methyl octamethylene groups, decamethylene groups, dodecamethylene groups and the like. Specifically, isoprene, butadiene, 3-methyl-1,2-butadiene, 2,3-dimethyl-1,3-butadiene, 1,2-polybutadiene, pentadiene, hexadiene, octadiene and the like.

Specific examples of the alicyclic group having 3 to 30 carbon atoms represented by $A_1$ in Formula (1) include, for instance, cyclopentadiene, cyclohexadiene, cyclooctadiene, norbornadiene, 1,4-cyclohexanedimethanol di(meth)acrylate, (2-(1-((meth)acryloyloxy)-2-methylpropane-2-yl)-5-ethyl-1,3-dioxane-5-yl)methyl (meth)acrylate, 1,3-adamantanediol di(meth)acrylate, 1,3-adamantanedimethanol di(meth)acrylate, tricyclo[5.2.1.$0^{2,6}$]decanedimethanol di(meth)acrylate, 1,4-cyclohexanedimethanol di(meth)acrylate, (2-(1-((meth)acryloyloxy)-2-methyl propane-2-yl)-5-ethyl-1,3-dioxane-5-yl)methyl (meth)acrylate, 1,3-adamantanediol di(meth)acrylate, 1,3-adamantanedimethanol di(meth)acrylate, tricyclo[5.2.1.$0^{2,6}$]decanedimethanol di(meth)acrylate and the like.

Preferably, the monomer (B) has at least one from among a vinyl group and a (meth)acrylic group.

Examples of the alkyl group having 6 to 30 carbon atoms and represented by $R_4$ in Formula (2) include, for instance, hexyl groups, ethylhexyl groups, 3,5,5-trimethyl hexyl groups, heptyl groups, octyl groups, 2-octyl groups, isooctyl groups, nonyl groups, decyl groups, isodecyl groups, undecyl groups, lauryl groups, tridecyl groups, myristyl groups, palmityl groups, stearyl groups, isostearyl groups, arachidyl groups, behenyl groups, lignoceryl groups, cerotoyl groups, montanyl groups, melissyl groups and the like. The number of carbon atoms in the alkyl group ranges preferably from 10 to 30, and more preferably from 12 to 24. The alkyl group represented by $R_4$ may be linear or branched. Preferably, $R_4$ is a linear alkyl group, in order to impart yet better contamination resistance.

Examples of the alicyclic group having 3 to 30 carbon atoms and represented by $R_4$ in Formula (2) include, for instance, cyclopropyl groups, cyclobutyl groups, cyclopentyl groups, cyclohexyl groups, 4-tert-butyl cyclohexyl groups, isobornyl groups, norbornenyl groups, menthyl groups, adamantyl groups, tricyclo[5.2.1.$0^{2,6}$]decanyl groups and the like.

Examples of the alkylene group having 2 to 6 carbon atoms and represented by $A_2$ in Formula (2) include, for instance, ethylene groups, trimethylene groups, methyl ethylene groups, tetramethylene groups, 1-methyl trimethylene groups, pentamethylene groups, 2,2-dimethyl trimethylene groups, hexamethylene groups and the like.

Preferably, n in Formulas (1) and (2) above is 0, photoconductor contamination resistance.

Examples of such monomer (B) include, for instance, hexyl (meth)acrylate, ethylhexyl (meth)acrylate, 3,5,5-trimethyl hexyl (meth)acrylate, heptyl (meth)acrylate, octyl (meth)acrylate, 2-octyl (meth)acrylate, isooctyl (meth)acrylate, nonyl (meth)acrylate, decyl (meth)acrylate, isodecyl (meth)acrylate, undecyl (meth)acrylate, lauryl (meth)acrylate, tridecyl (meth)acrylate, palmityl (meth)acrylate, stearyl (meth)acrylate, isostearyl (meth)acrylate, behenyl (meth) acrylate, cyclopropyl (meth)acrylate, cyclobutyl (meth) acrylate, cyclopentyl (meth)acrylate, cyclohexyl (meth) acrylate, 4-tert-butyl cyclohexyl (meth)acrylate, isobornyl (meth)acrylate, norbornene (meth)acrylate, menthyl (meth) acrylate, adamantane (meth)acrylate, tricyclo[5.2.1.0$^{2,6}$]decane(meth)acrylate, 2-hexyloxyethyl (meth)acrylate, 2-lauryloxyethyl (meth)acrylate, 2-stearyloxyethyl (meth) acrylate, 2-cyclohexyloxyethyl (meth)acrylate, trimethylene glycol-monolauryl ether-(meth)acrylate, tetramethylene glycol-monolauryl ether-(meth)acrylate, hexamethylene glycol-monolauryl ether-(meth)acrylate, diethylene glycol-monostearyl ether-(meth)acrylate, triethylene glycol-monostearyl ether-(meth)acrylate, tetraethylene glycol-monolauryl ether-(meth)acrylate, tetraethylene glycol-monostearyl ether-(meth)acrylate, hexaethylene glycol-monostearyl ether-(meth)acrylate and the like.

The monomer (B) may be used singly, or in the form of two or more types used concomitantly.

Examples of the azo-based polymerization initiator (C) of the present invention include, for instance, 2,2'-azobisisobutyronitrile, 2,2'-azobis(2-methylbutyronitrile), 2,2'-azobis(2,4-dimethylvaleronitrile), 1,1'-azobis(1-cyclohexane carbonitrile), 2,2'-azobis(4-methoxy-2,4-dimethyl valeronitrile), 2-(carbamoylazo)isobutyronitrile, dimethyl 1,1'-azobis(1-cyclohexane carboxylate) and the like. Preferred among the foregoing are 2,2'-azobis(2,4-dimethyl valeronitrile) and dimethyl 1,1'-azobis(1-cyclohexanecarboxylate) in terms of the surface modification effect on constituent materials and the electrical characteristics that the foregoing afford.

Specifically, the highly branched polymer used in the present invention is obtained by polymerizing the monomer (A) and the monomer (B), in the presence of a predetermined amount of the azo-based polymerization initiator (C) with respect to the monomer (A). In the present invention, the ratio of monomer (A) and monomer (B) during copolymerization of the foregoing ranges preferably from 5 to 300 mol %, more preferably from 10 to 150 mol % of the monomer (B), with respect to the number of moles of the monomer (A). The azo-based polymerization initiator (C) is used preferably in an amount of 5 to 200 mol %, more preferably in an amount of 50 to 100%, with respect to the number of moles of the monomer (A).

Examples of the polymerization method involved include, for instance, known methods such as solution polymerization, dispersion polymerization, precipitation polymerization, bulk polymerization and the like. Preferred among the foregoing is solution polymerization or precipitation polymerization. Particularly preferably, the reaction is carried out by solution polymerization in an organic solvent, from the viewpoint of molecular weight control.

Examples of solvents that are used herein include, for instance, aromatic hydrocarbons such as benzene, toluene, xylene, ethylbenzene, tetralin, o-dichlorobenzene and the like; aliphatic or alicyclic hydrocarbons such as n-hexane, cyclohexane and the like; halides such as methyl chloride, methyl bromide, chloroform and the like; esters or ester ethers such as ethyl acetate, butyl acetate, propylene glycol monomethyl ether acetate, propylene glycol monomethyl ether and the like; ethers such as tetrahydrofuran, 1,4-dioxane, methyl cellosolve and the like; ketones such as acetone, methyl ethyl ketone, methyl isobutyl ketone and the like; alcohols such as methanol, ethanol, n-propanol, isopropanol and the like; amides such as N,N-dimethylformamide, N,N-dimethylacetamide and the like; sulfoxides such as dimethyl sulfoxide and the like; as well as mixed solvents comprising two or more types of the foregoing. The amount of organic solvent can be set to 1 to 100 parts by mass with respect to 1 part by mass of the monomer (A).

The temperature during polymerization is 50 to 200° C.; more preferably, polymerization is carried out at a temperature that is higher by 20° C. or more than the 10-hour half life temperature of the azo-based polymerization initiator (C). After polymerization, the obtained highly branched polymer may be recovered in accordance with any method, such as re-precipitation in a poor solvent, precipitation or the like.

Examples of the highly branched polymer used in the present invention include, specifically, the highly branched polymers 1 to 16 and 18 to 36 described in the specification of WO 2012/128214. The polystyrene-equivalent molecular weight, measured by gel permeation chromatography, of the highly branched polymer used in the present invention ranges preferably from 1000 to 200000, more preferably from 2000 to 100000 and yet more preferably from 5000 to 60000.

The highly branched polymer used in the present invention is a so-called hyperbranched polymer, and has a dendritic structure that is highly branched, as that of dendrimers. As a characterizing feature of the highly branched polymer, however, branching in the latter yields an incomplete dendritic structure in which not all branching sites undergo polymerization, as in dendrimers. The degree of branching of the highly branched polymer can be generally estimated on the basis of respective quantities of terminal sites, branching sites and non-branching sites, and can be inferred by working out the rotation radius of a resin, by combining gel permeation chromatography (GPC) with light-scattering measurements. When the highly branched polymer and a linear or comb-like polymer of identical molecular weight, and synthesized using identical starting materials, are compared on the basis of molecular weight by GPC and the viscosity of a solution of the polymer dissolved in a solvent, it is found that, ordinarily, the highly branched polymer exhibits characteristically low viscosity thanks to a low degree of molecule entanglement, since the highly branched polymer takes on a spherical structure, and exhibits a long elution time in GPC, on account of the small rotation radius of the highly branched polymer; i.e. the molecular weight as measured by GPC is low.

Single Layer-Type Photoconductor

Conductive Support

The conductive support 1 functions as one electrode of the photoconductor, and, at the same time, constitutes a support of the various layers that make up the photoconductor. The conductive support 1 may be of any shape, for instance, cylindrical, plate-like or film-like, and the material thereof may be a metal such as aluminum, stainless steel, nickel or the like, or a material such as glass, a resin or the like the surface whereof has undergone a conductive treatment.

Undercoat Layer

The undercoat layer 2 is not fundamentally necessary in the present invention, but can be provided as needed. The undercoat layer 2 comprises a layer having a resin as a main component, or a metal oxide coating film of alumite or the like, and is provided for the purpose of enhancing adhesion between the photoconductive layer and the conductive support, and for the purpose of controlling the injectability of charge from the conductive base into the photoconductive layer. Examples of the resin material that is used in the undercoat layer include, for instance, insulating polymers such as casein, polyvinyl alcohol, polyamide, melamine, cellulose and the like, as well as conductive polymers such as polythiophene, polypyrrole, polyaniline and the like. These resins can be used singly or mixed with each other in appropriate combinations. The resins can contain a metal oxide such as titanium dioxide, zinc oxide or the like.

Photoconductive Layer

The photoconductive layer 3 comprises mainly a charge generation material, a hole transport material, an electron transport material and a binder resin.

Charge Generation Material

As the charge generation material there can be used X-type metal-free phthalocyanine singly, or α-type titanyl phthalocyanine, β-type titanyl phthalocyanine, Y-type titanyl phthalocyanine, γ-type titanyl phthalocyanine or amorphous-type titanyl phthalocyanine, singly or in appropriate combinations of the foregoing. An appropriate substance can be selected herein in accordance with the light wavelength region of the exposure light source that is used in image formation. Titanyl phthalocyanine having high quantum efficiency is optimal in terms of affording high sensitivity.

Hole Transport Material

As the hole transport material there can be used various hydrazone compounds, styryl compounds, diamine compounds, butadiene compounds, indole compounds and the like, singly or in appropriate combinations. Appropriate herein are however styryl-based compounds that comprise a triphenylamine skeleton, in terms of cost and performance. A triphenylamine of low molecular weight can also be used, as needed, as a plasticizer against cracking.

Electron Transport Material

The higher the mobility of the electron transport material, the more preferable the material is. Preferred materials herein include quinone-based materials such as benzoquinone and stilbenequinone, naphthoquinone, diphenoquinone, phenanthrenequinone, azoquinone and the like. Preferably, the content of the electron transport material is increased, while suppressing precipitation, by using one electron transport material singly, or two or more types, from the viewpoint of injectability into the charge transport layer and compatibility with the binder resin.

Binder Resin

As the binder resin there can be used a polycarbonate resin such as a bisphenol A or bisphenol Z, or a bisphenol A-biphenyl copolymer, or a polyarylate resin, a polyester resin, a polystyrene resin, a polyphenylene resin or the like, singly or in appropriate combinations. The resin is decided upon, among the foregoing, depending on pigment dispersibility, compatibility with the transport material and the highly branched polymer, and degree of segregation. It is effective to select a resin that is not prone to exhibiting residual stress. Suitable polycarbonates include resins in which the polymerization ratio of bisphenol A or bisphenol Z with a biphenyl copolymer has been optimized to an electrophotographic process.

Highly Branched Polymer

The highly branched polymer used in the present invention is a particle-shape resin having a branched structure. Accordingly, the highly branched polymer has the characterizing feature of enabling attachment of functional groups, having desired properties, to numerous terminal portions that are present at the surface of spherical particles, and of making it possible to control properties towards oils. The highly branched polymer of the present invention having an alkyl group at the ends in order to afford a lipophilic effect has the property of segregating at the surface, and causing oils to diffuse in the horizontal direction. The effect of the highly branched polymer is accordingly pronounced even when added in small amounts. Preferably, the highly branched polymer is added in an amount of 0.3 parts by mass to 6 parts by mass, in particular 0.5 parts by mass to 4 parts by mass, with respect to 100 parts by mass of the binder resin in the layer, in terms of securing good electrical characteristics, as the basic characteristic of the photoconductor, as well as appearance characteristics and fatigue characteristics.

Other Additives

An antioxidant or deterioration inhibitor such as a light stabilizer or the like can incorporated into the photoconductive layer for the purpose of enhancing environmental resistance and stability towards harmful light, as desired. Compounds used for such purposes include, for instance, chromanol derivatives such as tocopherol, as well as ester compounds, polyarylalkane compounds, hydroquinone derivatives, ether compounds, diether compounds, benzophenone derivatives, benzotriazole derivatives, thioether compounds, phenylenediamine derivatives, phosphonate esters, phosphite esters, phenol compounds, hindered phenol compounds, linear amine compounds, cyclic amine compounds, hindered amine compounds and the like.

A leveling agent such as a silicone oil or fluorine-based oil can be incorporated for the purpose of enhancing leveling in the formed film and/or imparting lubricity. Microparticles of a metal oxide such as silicon oxide (silica), titanium oxide, zinc oxide, calcium oxide, aluminum oxide (alumina), zirconium oxide or the like, or of a metal sulfate such as barium sulfate, calcium sulfate or the like, or of a metal nitride such as silicon nitride, aluminum nitride or the like, may be further incorporated with a view to, for instance, adjusting film hardness, lowering the coefficient of friction and imparting lubricity. Other known additives can be further incorporated, as needed, so long as electrophotographic characteristics are not significantly impaired thereby.

Composition

The mass ratio of the sum of the functional materials (charge generation material, electron transport material and hole transport material) and the binder resin inside the photoconductive layer is set to lie in the range 35:65 to 65:35, in order to achieve desired characteristics. When the mass ratio of the functional materials is greater than 65 mass % in the photoconductive layer, i.e. when the amount of binder resin is smaller than 35 mass %, a film reduction amount increases and durability decreases, and, moreover, the glass transition point drops; as a result, creep strength becomes insufficient, toner filming and filming of external additives and of paper dust are likelier to occur, and contact member contamination (creep deformation) becomes also prone to occur, while contamination derived from oils/fats such as grease, and sebum contamination, tend likewise to worsen. When the mass ratio of the above functional materials is smaller than 35 mass % in the photoconductive layer, i.e. when the amount of binder resin is greater than 65 mass %, it becomes difficult to obtain a desired sensitivity characteristic, and the photoconductor may be unsuitable for practical use. Generally, the binder resin ratio is set to be high, from the viewpoint of suppressing member contamination, contamination by oils/fats, and sebum contamination, while securing durability.

The content ratio of the charge generation material ranges preferably from 0.5 to 3 mass % more preferably from 0.8 to 1.8 mass %, with respect to the film as a whole. When the amount of charge generation material is excessively small, sensitivity characteristics become insufficient, and the likelihood of occurrence of interference fringes increases. When the amount is excessively large, both charging characteristic and fatigue characteristics (repeated use stability) are likelier to be insufficient.

The mass ratio of the electron transport material and the hole transport material can vary within the range 1:1 to 1:4, but, in general, from the viewpoint of transport balance between holes and electrons, a more preferred range of mass ratio to be resorted to is 1:1 to 1:3, from the viewpoint of sensitivity characteristic, charging characteristic and fatigue characteristic.

Solvent

Examples of the solvent of the photoconductive layer include, for instance, halogenated hydrocarbons such as dichloromethane, dichloroethane, chloroform, carbon tetrachloride, chlorobenzene and the like; ethers such as dimethyl ether, diethyl ether, tetrahydrofuran, dioxane, dioxolane, ethylene glycol dimethyl ether, diethylene glycol dimethyl ether and the like; and ketones such as acetone, methyl ethyl ketone, cyclohexanone and the like. The foregoing materials can be selected as appropriate from the viewpoint of solubility of various materials, liquid stability and coatability.

Thickness

The thickness of the photoconductive layer lies preferably in the range 12 to 40 μm, preferably in the range 15 to 35 μm, and more preferably in the range 20 to 30 μm, from the viewpoint of securing effective performance in practice.

Multilayer-Type Photoconductor

Conductive Support

The conductive support 1 is identical to that of the single layer-type photoconductor.

Undercoat Layer

The undercoat layer 2 is identical to that of the single layer-type photoconductor, and is not fundamentally necessary in the present invention, but can be provided as needed.

Charge Transport Layer

The charge transport layer 4 can be configured mainly out of a hole transport material and a binder resin.

Hole Transport Material

The hole transport material that is used in the charge transport layer 4 is identical to that of the single layer-type photoconductor. Herein, however, the charge transport layer 4 constitutes an inward layer, and, accordingly, a greater amount of triphenylamine of low molecular weight can be used, as a plasticizer against cracking, than in the case of the single layer-type organic photoconductor.

Binder Resin

The binder resin of the charge transport layer 4 is identical to that of the single layer-type photoconductor. Herein, however, the charge transport layer 4 constitutes an inward layer; accordingly, the charge transport layer 4 need not exhibit that much mechanical strength, but must not be prone to elution upon coating of the charge generation layer 5. Such being the case, a resin is suitably used herein that does not elute readily in the solvent of the charge generation layer, preferably a resin of high molecular weight.

Other Additives

An antioxidant or deterioration inhibitor such as a light stabilizer or the like can incorporated to the charge transport layer 4 for the purpose of enhancing environmental resistance and stability towards harmful light, as desired. Compounds used for such purposes include, for instance, chromanol derivatives such as tocopherol, as well as ester compounds, polyarylalkane compounds, hydroquinone derivatives, ether compounds, diether compounds, benzophenone derivatives, benzotriazole derivatives, thioether compounds, phenylenediamine derivatives, phosphonate esters, phosphite esters, phenol compounds, hindered phenol compounds, linear amine compounds, cyclic amine compounds, hindered amine compounds and the like.

A leveling agent such as a silicone oil or fluorine-based oil can be incorporated for the purpose of enhancing leveling in the formed film and/or imparting lubricity. Microparticles of a metal oxide such as silicon oxide (silica), titanium oxide, zinc oxide, calcium oxide, aluminum oxide (alumina), zirconium oxide or the like, or of a metal sulfate such as barium sulfate, calcium sulfate or the like, or of a metal nitride such as silicon nitride, aluminum nitride or the like, may be further incorporated with a view to, for instance, adjusting film hardness, lowering the coefficient of friction and imparting lubricity. Other known additives can be further incorporated, as needed, so long as electrophotographic characteristics are not significantly impaired thereby.

Composition

The mass ratio of the hole transport material and the binder resin in the charge transport layer 4 can be set to range from 1:3 to 3:1 (25:75 to 75:25), and ranges preferably from 1:1.5 to 1.5:1 (40:60 to 60:40). When the content of the hole transport material is smaller than 25 mass % in the charge transport layer 4, the transport function becomes generally insufficient, and residual potential increases; also, the environmental dependence of the exposed section potential inside the device increases, and environmental stability of image quality becomes poorer. The photoconductor may become therefore unsuitable for use. On the other hand, the adverse effect of elution upon coating of the charge generation layer 5 may be a concern when the content of the hole transport material is greater than 75 mass % in the charge transport layer 4, i.e. when the amount of binder resin in the charge transport layer 4 is smaller than 25 mass %.

Solvent

Examples of the solvent of the charge transport layer 4 include, for instance, halogenated hydrocarbons such as dichloromethane, dichloroethane, chloroform, carbon tetrachloride, chlorobenzene and the like; ethers such as dimethyl ether, diethyl ether, tetrahydrofuran, dioxane, dioxolane, ethylene glycol dimethyl ether, diethylene glycol dimethyl ether and the like; and ketones such as acetone, methyl ethyl ketone, cyclohexanone and the like. The foregoing materials can be selected as appropriate from the viewpoint of solubility of various materials, liquid stability and coatability.

Thickness

The thickness of the charge transport layer 4 is established in consideration of the charge generation layer 5 described below, but lies preferably in the range 3 to 40 μm, more preferably in the range 5 to 30 μm, and yet more preferably in the range 10 to 20 μm, from the viewpoint of securing effective performance in practice.

Charge Generation Layer

The charge generation layer 5 is formed in accordance with a method that involves, for instance, applying a coating solution in which particles of a charge generation material are dispersed in a binder resin in which a hole transport material and an electron transport material have been dissolved. The charge generation layer 5 has the function of generating carriers, when receiving light, carrying generated electrons to the photoconductor surface, and carrying holes to the charge transport layer 4. High carrier generation efficiency, coupled at the same time with injectability of the generated holes into the charge transport layer 4, is an important issue in the charge generation layer 5. Preferably, thus, the charge generation layer 5 exhibits little electric field dependence and affords good injection even in low fields.

Charge Generation Material

The charge generation material is identical to that of the single layer-type photoconductor, and an appropriate substance can be selected herein in accordance with the light wavelength region of the exposure light source that is used in image formation. Titanyl phthalocyanine having high quantum efficiency is optimal herein in terms of achieving high sensitivity.

Hole Transport Material

Inasmuch as holes are to be injected into the charge transport layer, the hole transport material exhibits preferably a small difference in ionization potential with respect to that of the charge transport material in the charge transport layer, specifically an ionization potential that is no greater than 0.5 eV. In the present invention, in particular, the charge generation layer 5 is formed by being coated on the charge transport layer 4. Preferably, therefore, the hole transport material comprised in the charge transport layer 4 is comprised also in the charge generation layer 5, more preferably, the same material is used as the hole transport materials that are used in the charge transport layer 4 and in the charge generation layer 5, in order to suppresses the influence of elution of the charge transport layer 4 into the coating solution, and stabilize the liquid state of the charge generation layer 5, during application of the charge generation layer 5.

Electron Transport Material

The electron transport material is identical to that of the single layer-type photoconductor, Although the higher the mobility of the electron transport material, the more preferable the material is, the content of the electron transport material is preferably increased, while suppressing precipitation, by using one electron transport material singly, or in the form of two or more types, from the viewpoint of injectability into the charge transport layer and compatibility with the binder resin.

Binder Resin

As the binder resin for the charge generation layer there can be used a polycarbonate resin such as a bisphenol A or bisphenol Z, or a bisphenol A-biphenyl copolymer, or a polyarylate resin, a polyester resin, a polystyrene resin, a polyphenylene resin or the like, singly or in appropriate combinations. Preferred among the foregoing are polycarbonate resins, from the viewpoint of dispersion stability in the charge generation material, compatibility with the hole transport material and the electron transport material, mechanical stability, chemical stability and thermal stability. In particular, as in the case of the hole transport material, the binder resin comprised in the charge transport layer 4 is comprised also in the charge generation layer 5, more preferably, the same binder resin is used as the binder resins that are used in the charge transport layer 4 and in the charge generation layer 5, in order to suppresses the influence of elution of the charge transport layer 4 into the coating solution, and stabilize the liquid state of the charge generation layer 5, during application of the charge generation layer 5.

Highly Branched Polymer

The highly branched polymer that is used in the present invention is as described above, and is identical to that of the single layer-type photoconductor. The addition amount of the highly branched polymer can be set to the same addition amount as in the case of the single layer-type photoconductor.

Other Additives

An antioxidant or deterioration inhibitor such as a light stabilizer or the like can incorporated to the charge transport layer 4 for the purpose of enhancing environmental resistance and stability towards harmful light, as desired. Compounds used for such purposes include, for instance, chromanol derivatives such as tocopherol, as well as ester compounds, polyarylalkane compounds, hydroquinone derivatives, ether compounds, diether compounds, benzophenone derivatives, benzotriazole derivatives, thioether compounds, phenylenediamine derivatives, phosphonate esters, phosphite esters, phenol compounds, hindered phenol compounds, linear amine compounds, cyclic amine compounds, hindered amine compounds and the like.

A leveling agent such as a silicone oil or fluorine-based oil can be incorporated for the purpose of enhancing leveling in the formed film and/or imparting lubricity. Microparticles of a metal oxide such as silicon oxide (silica), titanium oxide, zinc oxide, calcium oxide, aluminum oxide (alumina), zirconium oxide or the like, or of a metal sulfate such as barium sulfate, calcium sulfate or the like, or of a metal nitride such as silicon nitride, aluminum nitride or the like, may be further incorporated with a view to, for instance, adjusting film hardness, lowering the coefficient of friction and imparting lubricity. Other known additives can be further incorporated, as needed, so long as electrophotographic characteristics are not significantly impaired thereby.

Composition

The distribution amounts of the various functional materials (charge generation material, electron transport material and hole transport material) in the charge generation layer 5 are set as follows. Firstly, the content ratio of the charge generation material in the charge generation layer 5 of the present invention ranges preferably from 1 to 4 mass %, in particular 1.5 to 3.0 mass % in the charge generation layer 5. The mass ratio of the sum of functional materials (charge generation material, electron transport material and hole transport material) and the binder resin in the charge generation layer 5 is set to a range of 35:65 to 65:35, in order to achieve desired characteristics. Preferably, however, the amount of binder resin is set to be large by prescribing the above mass ratio to be 50 or less: 50 or more, from the viewpoint of suppressing member contamination, contamination by oils/fats, and sebum contamination, while securing durability.

When the mass ratio of the functional materials is greater than 65 mass % in the charge generation layer 5, i.e. when the amount of binder resin is smaller than 35 mass %, the film reduction amount increases and durability decreases, and, moreover, the glass transition point drops; as a result, creep strength becomes insufficient, toner filming and filming of external additives and of paper dust are likelier to occur, and contact member contamination (creep deformation) becomes also prone to occur, while contamination derived from oils/fats such as grease, and sebum contamination, tend likewise to worsen. When the mass ratio of the functional materials is smaller than 35 mass % in the charge generation layer 5, i.e. when the amount of binder resin is greater than 65 mass %, it becomes difficult to obtain a desired sensitivity characteristic, and the photoconductor may be unsuitable for practical use.

The mass ratio of the electron transport material and the hole transport material can vary within the range 1:5 to 5:1. In the present invention, the charge transport layer 4 having a hole transport function is present under the charge generation layer 5. Accordingly, an appropriate range of the mass ratio of the electron transport material and the hole transport material herein is 5:1 to 4:2, and, more preferably, in particular 4:1 to 3:2, in terms of overall characteristics, contrary to what is the case in a composition rich in hole transport material, with an ordinary mass ratio in the range 1:5 to 2:4, in a single layer-type organic photoconductor. In the multilayer-type photoconductor according to the present invention, thus, the hole transport material can be formulated in a greater amount in the charge transport layer 4, as the lower layer. Therefore, the multilayer-type photoconductor has a characterizing feature wherein, unlike the case of the single layer-type photoconductor, it is possible to keep a low content of the hole transport material, which is one cause of occurrence of cracks derived from sebum adhesion, in the charge generation layer 5.

Solvent

Examples of the solvent of the charge generation layer 5 include, for instance, halogenated hydrocarbons such as dichloromethane, dichloroethane, chloroform, carbon tetrachloride, chlorobenzene and the like; ethers such as dimethyl ether, diethyl ether, tetrahydrofuran, dioxane, dioxolane, ethylene glycol dimethyl ether, diethylene glycol dimethyl ether and the like; and ketones such as acetone, methyl ethyl ketone, cyclohexanone and the like. Among the foregoing, solvents are used that have ordinarily a high boiling point, specifically, solvents having a boiling point of 60° C. or higher, and particularly having a boiling point of 80° C. or higher. In a case where, titanyl phthalocyanine of high quantum efficiency is used in the charge generation material to enhance sensitivity, then dichloroethane, having a high specific gravity and a boiling point of 80° C. or higher, is preferably used, among the foregoing, as the solvent that is utilized to form the charge generation layer, in terms of dispersion stability and little proclivity to elute into the charge transport layer.

Thickness

The thickness of the charge generation layer 5 is established in consideration of the charge transport layer 4. The thickness of the charge generation layer 5 lies preferably in the range 3 μm to 40 μm, preferably in the range 5 μm to 30 μm, and more preferably in the range 10 μm to 20 μm, from the viewpoint of securing effective performance in practice.

A characterizing feature of the method for producing coating solution of an outermost layer, the coating solution containing a charge generation material, a hole transport material, an electron transport material and a binder resin, and in addition, the highly branched polymer according to the present invention, to produce an electrophotographic photoconductor provided with a photoconductive layer that contains at least a charge generation material, a hole transport material, an electron transport material and a binder resin. As a result, it becomes possible to obtain a photoconductor that has excellent surface contamination resistance, stable electrical characteristics and so forth upon repeated use, and superior transfer resistance and gas resistance. Other details of the production process, solvents used to produce the coating solution, among other features, are not particularly limited, and can be determined as appropriate, according to conventional methods. For instance, the coating solution in the production method of the present invention is not limited to any given coating method, and can be used in various coating methods such as dip coating and spray coating.

Electrophotographic Apparatus

The electrophotographic apparatus of the present invention is equipped with the photoconductor of the present invention, and affords intended effects by being used in various machine processes. Specifically, sufficient effects can be elicited in a charging process, for instance, a contact charging scheme relying on rollers or brushes, a contactless charging scheme relying on a charging member such as a corotron, scorotron or the like, and in a development process, for instance contact development and contactless development schemes (developers) relying on non-magnetic single-component development, magnetic single-component development, and two-component development.

Figure 3:
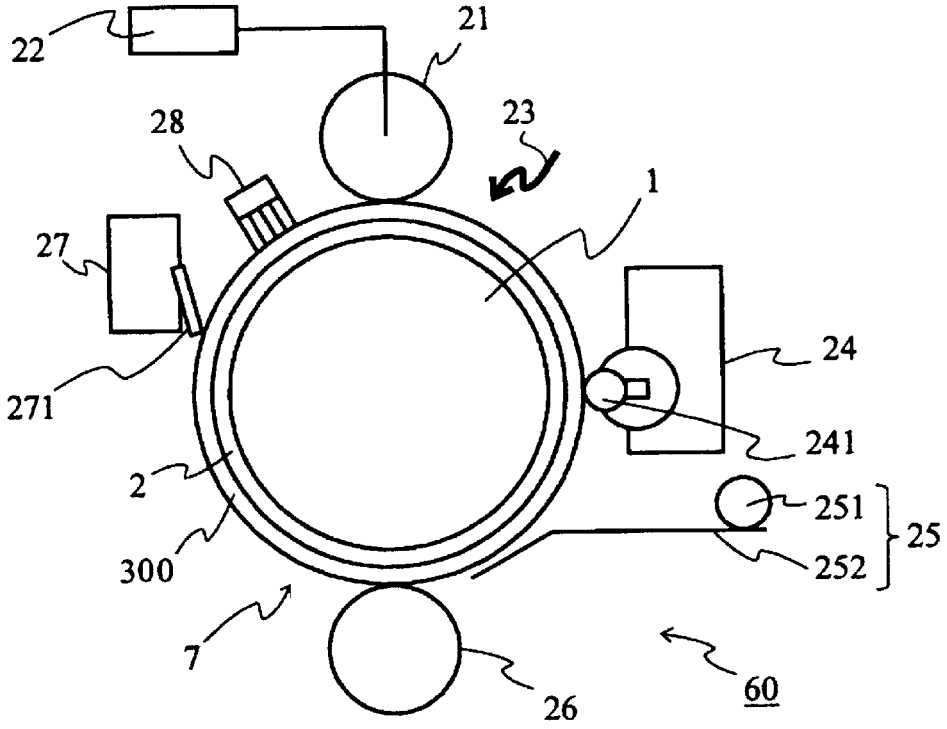
FIG. 3 is a schematic configuration diagram illustrating a configuration example of an electrophotographic apparatus of the present invention.

As an example, FIG. 3 is a schematic configuration diagram illustrating a configuration example of the electrophotographic apparatus of the present invention. An electrophotographic apparatus 60 of the present invention illustrated in the figure is equipped with a electrophotographic photoconductor 7 of the present invention that comprises a conductive support 1, an undercoat layer 2 that covers the outer peripheral face of the conductive support 1, and a photoconductive layer 300. The electrophotographic apparatus 60 is further provided with at least a charging process and a development process. The electrophotographic apparatus 60 is made up of: a charging device 21 which is a roller charging member 21 that is disposed on the outer peripheral edge of the photoconductor 7; a high-voltage power source 22 that supplies applied voltage to the roller charging member 21; an image exposure member 23; a developing device 24 comprising a developing roller 241; a paper feed member 25 comprising a paper feed roller 251 and a paper feed guide 252; a transfer charger (of direct charging type) 26; a cleaning device 27 comprising a cleaning blade 271; and a charge removing member 28. The electrophotographic apparatus 60 of the present invention can be used as a color printer.

Examples

Specific embodiments of the present invention will be explained next in further detail with reference to examples. So long as the gist of the present invention is not departed from, the scope of the invention is not limited to these examples.

Production Example of an Electrophotographic Photoconductor

The conductive support used herein was a 0.75 mm thick-walled tube made of aluminum, having two types of shape, ϕ30 mm×length 244.5 mm and mm×length 252.6 mm, and cut to a surface roughness (Rmax) of 0.2 μm.

Materials Used in Experiments

Charge Generation Material

The metal-free phthalocyanine (CG-1) and Y-type titanyl phthalocyanine (CG-2) having Structural formulas 1 and 2 below were used as the charge generation material.

Structural formula 1 (CG-1)

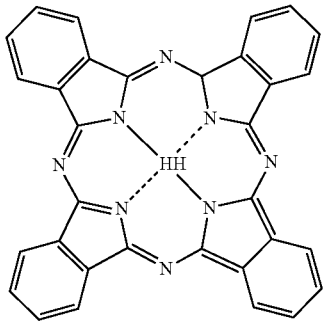

-continued

Structural formula 2 (CG-2)

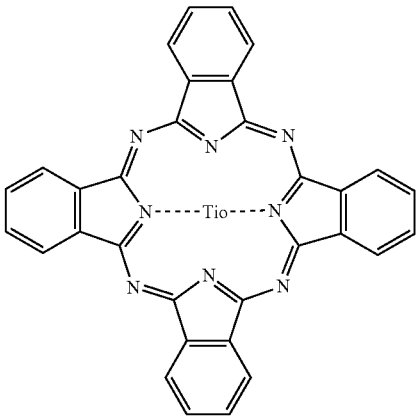

Hole Transport Material

Styryl compounds (HT-1, HT-2 and HT-3) represented by Structural formulas 3 to 5 below were used as the hole transport material.

Structural formula 3 (HT-1)

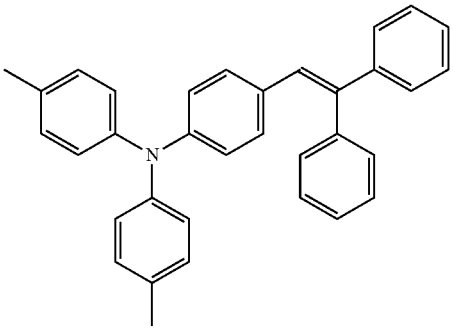

Structural formula 4 (HT-2)

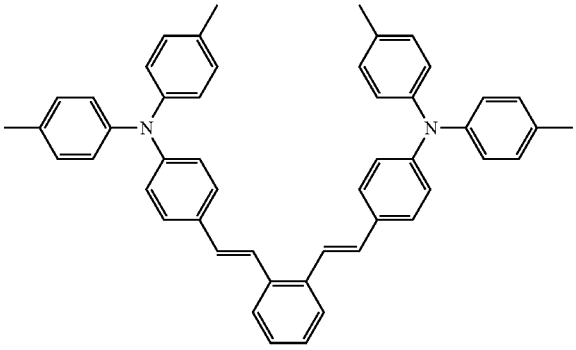

-continued

Structual formula 5 (HT-3)

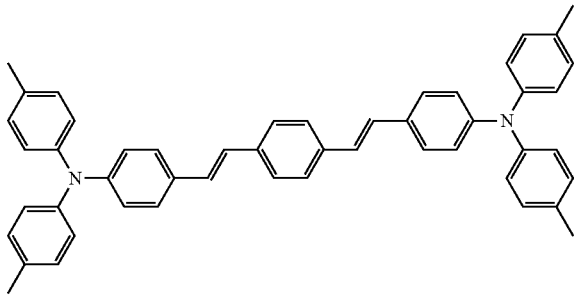

Electron Transport Material

The quinone-based compounds (ET-1, ET-2 and ET-3) represented by Structural formulas 6 to 8 below were used as the electron transport material.

Structural formula 6 (ET-1)

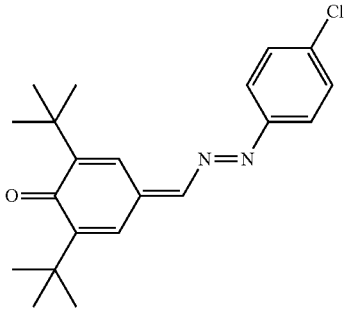

Structural formula 7 (ET-2)

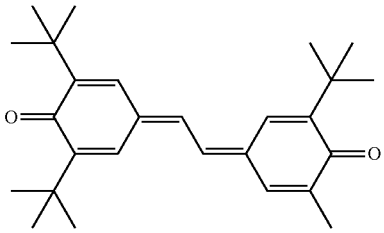

Structural formula 8 (ET-3)

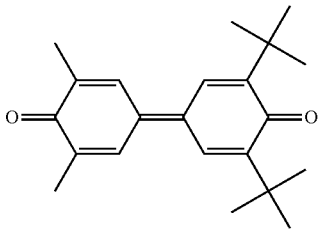

Binder Resin

The polycarbonate resins (NR-1, NR-2 and NR-3) made up of structural units represented by Structural formulas 9 to 11 below were used as the binder resin.

Structural formula 9 (NR-1)

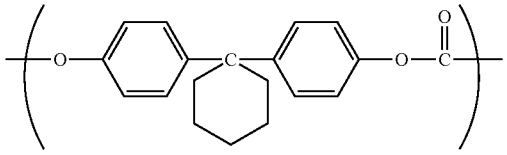

Structural formula 10 (NR-2)

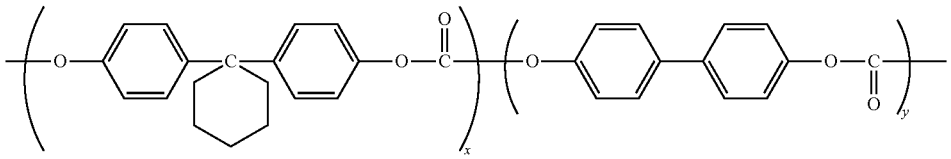

x/(x + y) = 0.6 ~ 0.9

Structural formula 11 (NR-3)

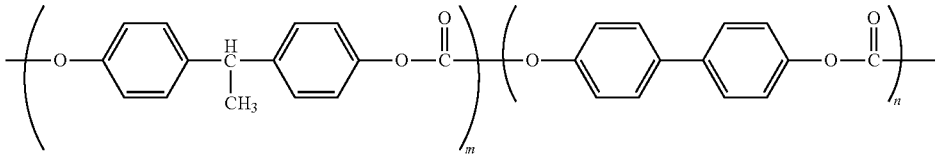

m/(m + n) = 0.6 ~ 0.9

Highly Branched Polymer

A highly branched polymer was synthesized in accordance with the below-described method disclosed in the specification of WO 2012/128214. Specifically, 53 g of toluene were placed in a 200-ml flask with nitrogen influx and the temperature was raised to 110° C. under reflux, with stirring for 5 minutes or longer. Then, 6.6 g (20 mmol) of tricyclo[5.2.1.02,6]decanedimethanol di(meth)acrylate, as the monomer (A), 2.4 g (10 mmol) of lauryl acrylate, as the monomer (B), 3.0 g (12 mmol) of 2,2'-azobis(2,4-dimethyl valeronitrile), as the initiator (C), and 53 g of toluene were placed in a separate 100-ml flask, and the flask was ice-cooled down to 0° C., with nitrogen influx, under stirring.

The solution in the 100-ml flask was dripped, over 30 minutes, onto the toluene in the 200-ml flask. Once dripping was over, the flask was stirred for one hour. Then 80 g of toluene were evaporated and distilled off the reaction solution under reduced pressure. Thereafter, the resulting product was added to 330 g hexane/ethanol (mass ratio 1:2), to elicit precipitation. The resulting liquid was vacuum-filtered and vacuum-dried, to yield 6.4 g of a polymer in the form of a white powder (highly branched polymer 1, BR1 described in the specification of WO 2012/128214). The polystyrene-equivalent molecular weight of the polymer when measured in accordance with the GPC measurement method disclosed in the specification of WO 2012/128214 was Mw=7800.

Highly branched polymers BR2 to 9 in the examples were as follows.

BR2: highly branched polymer 2 described in the patent specification above (Mw=13,000)

BR3: highly branched polymer 3 described in the patent specification above (Mw=10,000)

BR4: highly branched polymer 4 described in the patent specification above (Mw=8,200)

BR5: highly branched polymer 8 described in the patent specification above (Mw=10,000)

BR6: highly branched polymer 9 described in the patent specification above (Mw=6,600)

BR7: highly branched polymer 10 described in the patent specification above (Mw=13,000)

BR8: highly branched polymer 26 described in the patent specification above (Mw=9,500)

BR9: highly branched polymer 27 described in the patent specification above (Mw=8,800)

Additives

As an antioxidant, 0.49 mass % of dibutyl hydroxytoluene (BHT), being a hindered phenol-based antioxidant by Kirin Kyowa Foods Co., Ltd. was added to the outermost layer. Further, 0.01 mass % of a dimethyl silicone oil KF-56 by Shin-Etsu Chemical Co., Ltd., as a lubricant, were added to the outermost layer.

Solvent

Herein 1,2-dichloroethane was used as the solvent.

Production of a Coating Solution

Single Layer-Type Photoconductor Coating Solution

Each of the above hole transport materials, electron transport materials, binder resins, highly branched polymers and additives were weighed to desired weights, were added to a vessel filled with a predetermined solvent, and were dissolved therein. Next, each of the above charge generation materials weighed to a predetermined weight ratio were added, followed by dispersion using a Dynomill (MULTI-LAB by Shinmaru Enterprise Co., Ltd.), to produce a respective single layer-type photoconductor coating solution. The material composition ratios are given in Tables 2 and 3.

Multilayer-Type Photoconductor Coating Solution

Charge Transport Layer Coating Solution

Charge transport layer coating solutions were produced using a dichloroethane solvent, so as to yield the three material compositions below, as given in the tables.

TABLE 1

| | Hole transport material | | Binder resin | | Antioxidant | | Lubricant | |
|---|---|---|---|---|---|---|---|---|
| Layer | Material | Content (mass %) | Material | Content (mass %) | Material | Content (mass %) | Material | Content (mass %) |
| CT-1 | HT-1 | 50 | NR-1 | 49.5 | BHT | 0.49 | KF56 | 0.01 |
| CT-2 | HT-2 | 50 | NR-2 | 49.5 | BHT | 0.49 | KF56 | 0.01 |
| CT-3 | HT-3 | 50 | NR-3 | 49.5 | BHT | 0.49 | KF56 | 0.01 |

Charge Generation Layer Coating Solution

Each of the above hole transport materials, electron transport materials, binder resins, highly branched polymers and additives were weighed to desired weights, were added to a vessel filled with a predetermined solvent, and were dissolved therein. Next, each of the above charge generation materials weighed to a predetermined weight ratio were added, followed by dispersion using a Dynomill (MULTI-LAB by Shinmaru Enterprise Co., Ltd.), to produce a respective charge generation layer coating solution. The material composition ratios are given in Tables 4 and 5.

Production of a Photoconductor

Single Layer-Type Photoconductor

The above conductive support was dip-coated with the above single layer-type photoconductor coating solution, followed by hot-air drying at 110° C. for 60 minutes, to yield photoconductors having a thickness of 30±2 μm, with the material compositions given in Tables 2 and 3.

Multilayer-Type Photoconductor

The above conductive support was dip-coated with each of the above charge transport coating solutions, followed by hot-air drying at 110° C. for 30 minutes, to yield a respective charge transport layer having a thickness of 15±1 μm. Next, the above charge generation layer coating solution was dip-coated, followed by hot-air drying at 110° C. for 30 minutes, to yield a respective multilayer-type photoconductor having a total thickness of 30±2 μm.

Photoconductor Evaluation (1) Fatigue Characteristic (Electrical Characteristic)

For the photoconductor having a shape of ϕ30 mm×length 244.5 mm that used CG-1, there were printed 5,000 prints of an image having a print area ratio of 4%, at intervals of 10 seconds, in a 10° C. and 20% RH environment, using a 24-ppm model monochrome laser printer (HL-2450) commercially available from Brother Industries, Ltd., and there was measured the potential amount of change of a developed section of the photoconductor.

For the photoconductor having a shape of ϕ30 mm×length 252.6 mm that used CG-2, there were printed 5,000 prints of an image having a print area ratio of 4%, at intervals of 10 seconds, in a 10° C. and 20% RH environment, using a 16-ppm model color LED printer (HL-3040) commercially available from Brother Industries, Ltd., and there was measured the potential amount of change of a developed section, with black toner, of the photoconductor.

In both devices, an amount of change of the charging potential no greater than 30 V was rated as good (○), an amount of change in the range 30 to 70 V was rated as fair (Δ), and an amount of change is 70 V or greater was rated as poor (x).

(2) Contamination Resistance (Resistance to Oil Contamination by Human Scalp)

Scalp was brought to into contact with the photoconductor surface and was left to stand thus for 10 days. Thereafter, a halftone image of a 1-on-2-off pattern was printed using the above monochrome laser printer, and the presence or absence of white spot defects and black spots due to cracks was assessed. The results were graded as good (○) for 0 sites of image defects, fair (Δ) for 1 to 3 sites, and poor (x) for 4 or more sites, from among 30 sites.

(3) Appearance Characteristic (Smoothness)

The surface state was observed at 200 magnifications under an optical microscope, and the smoothness of the surface was evaluated sensorily. Instances exactly identical to those where no highly branched polymer was added were rated as good (○), instances where some slight change was observed were rated as fair (Δ), and instances where the smoothness of appearance was impaired were rated as poor (x).

The obtained results are given in Tables 6 to 9 below. All numerical values in the tables are mass %.

TABLE 2

| | Charge generation material | | Hole transport material | | Electron transport material | | Binder resin | | Highly branched polymer | | Additive content | |
|---|---|---|---|---|---|---|---|---|---|---|---|---|
| | Material | Content | Material | Content | Material | Content | Material | Content | Material | Content | BHT | KF56 |
| Conv. Ex. 1 | CG-1 | 0.8 | HT-1 | 29.35 | ET-1 | 29.35 | NR-1 | 40 | BR-1 | 0 | 0.49 | 0.01 |
| Exper. Ex. 1 | | 0.8 | | 29.29 | | 29.29 | | 40 | | 0.12 | | |
| Exper. Ex. 2 | | 1 | | 31.96 | | 21.31 | | 45 | | 0.23 | | |
| Exper. Ex. 3 | | 1.2 | | 31.87 | | 15.93 | | 50 | | 0.5 | | |
| Exper. Ex. 4 | | 1.5 | | 29.34 | | 11.73 | | 55 | | 1.93 | | |
| Exper. Ex. 5 | | 1.8 | | 25.58 | | 8.53 | | 60 | | 3.6 | | |
| Exper. Ex. 6 | | 1.8 | | 23.63 | | 8.87 | | 60 | | 6.2 | | |
| Conv. Ex. 2 | CG-1 | 0.8 | HT-2 | 29.35 | ET-1 | 29.35 | NR-1 | 40 | BR-1 | 0 | | |
| Exper. Ex. 7 | | 0.8 | | 29.29 | | 29.29 | | 40 | | 0.12 | | |
| Exper. Ex. 8 | | 1 | | 31.96 | | 21.31 | | 45 | | 0.23 | | |
| Exper. Ex. 9 | | 1.2 | | 31.87 | | 15.93 | | 50 | | 0.5 | | |
| Exper. Ex. 10 | | 1.5 | HT-3 | 29.34 | | 11.73 | | 55 | | 1.93 | | |
| Exper. Ex. 11 | | 1.8 | | 25.58 | | 8.53 | | 60 | | 3.6 | | |
| Exper. Ex. 12 | | 1.8 | | 23.63 | | 8.87 | | 60 | | 6.2 | | |
| Conv. Ex. 3 | CG-1 | 0.8 | HT-1 | 29.35 | ET-2 | 29.35 | NR-1 | 40 | BR-1 | 0 | | |

TABLE 2-continued

| | Charge generation material | | Hole transport material | | Electron transport material | | Binder resin | | Highly branched polymer | | Additive content | |
|---|---|---|---|---|---|---|---|---|---|---|---|---|
| | Material | Content | Material | Content | Material | Content | Material | Content | Material | Content | BHT | KF56 |
| Exper. Ex. 13 | | 0.8 | | 29.29 | | 29.29 | | 40 | | 0.12 | | |
| Exper. Ex. 14 | | 1 | | 31.96 | | 21.31 | | 45 | | 0.23 | | |
| Exper. Ex. 15 | | 1.2 | | 31.87 | | 15.93 | | 50 | | 0.5 | | |
| Exper. Ex. 16 | | 1.5 | | 29.34 | ET-3 | 11.73 | | 55 | | 1.93 | | |
| Exper. Ex. 17 | | 1.8 | | 25.58 | | 8.53 | | 60 | | 3.6 | | |
| Exper. Ex. 18 | | 1.8 | | 23.63 | | 8.87 | | 60 | | 6.2 | | |
| Conv. ex 4 | CG-1 | 0.8 | HT-1 | 29.35 | ET-1 | 29.35 | NR-2 | 40 | BR-1 | 0 | | |
| Exper. Ex. 19 | | 0.8 | | 29.29 | | 29.29 | | 40 | | 0.12 | | |
| Exper. Ex. 20 | | 1 | | 31.96 | | 21.31 | | 45 | | 0.23 | | |
| Exper. Ex. 21 | | 1.2 | | 31.87 | | 15.93 | | 50 | | 0.5 | | |
| Exper. Ex. 22 | | 1.5 | | 29.34 | | 11.73 | NR-3 | 55 | | 1.93 | | |
| Exper. Ex. 23 | | 1.8 | | 25.58 | | 8.53 | | 60 | | 3.6 | | |
| Exper. Ex. 24 | | 1.8 | | 23.63 | | 8.87 | | 60 | | 6.2 | | |
| Conv. Ex. 5 | CG-1 | 0.8 | HT-1 | 29.35 | ET-1 | 29.35 | NR-1 | 40 | BR-2 | 0 | | |
| Exper. Ex. 25 | | 0.8 | | 29.29 | | 29.29 | | 40 | | 0.12 | | |
| Exper. Ex. 26 | | 1 | | 31.96 | | 21.31 | | 45 | | 0.23 | | |
| Exper. Ex. 27 | | 1.2 | | 31.87 | | 15.93 | | 50 | | 0.5 | | |
| Exper. Ex. 28 | | 1.5 | | 29.34 | | 11.73 | | 55 | BR-3 | 1.93 | | |
| Exper. Ex. 29 | | 1.8 | | 25.58 | | 8.53 | | 60 | | 3.6 | | |
| Exper. Ex. 30 | | 1.8 | | 23.63 | | 8.87 | | 60 | | 6.2 | | |
| Conv. Ex. 6 | CG-1 | 0.8 | HT-1 | 29.35 | ET-1 | 29.35 | NR-1 | 40 | BR-4 | 0 | | |
| Exper. Ex. 31 | | 0.8 | | 29.29 | | 29.29 | | 40 | | 0.12 | | |
| Exper. Ex. 32 | | 1 | | 31.96 | | 21.31 | | 45 | | 0.23 | | |
| Exper. Ex. 33 | | 1.2 | | 31.87 | | 15.93 | | 50 | | 0.5 | | |
| Exper. Ex. 34 | | 1.5 | | 29.34 | | 11.73 | | 55 | BR-5 | 1.93 | | |
| Exper. Ex. 35 | | 1.8 | | 25.58 | | 8.53 | | 60 | | 3.6 | | |
| Exper. Ex. 36 | | 1.8 | | 23.63 | | 8.87 | | 60 | | 6.2 | | |
| Conv. Ex. 7 | CG-1 | 0.8 | HT-1 | 29.35 | ET-1 | 29.35 | NR-1 | 40 | BR-6 | 0 | | |
| Exper. Ex. 37 | | 0.8 | | 29.29 | | 29.29 | | 40 | | 0.12 | | |
| Exper. Ex. 38 | | 1 | | 31.96 | | 21.31 | | 45 | | 0.23 | | |
| Exper. Ex. 39 | | 1.2 | | 31.87 | | 15.93 | | 50 | | 0.5 | | |
| Exper. Ex. 40 | | 1.5 | | 29.34 | | 11.73 | | 55 | BR-7 | 1.93 | | |
| Exper. Ex. 41 | | 1.8 | | 25.58 | | 8.53 | | 60 | | 3.6 | | |
| Exper. Ex. 42 | | 1.8 | | 23.63 | | 8.87 | | 60 | | 6.2 | | |
| Conv. Ex. 8 | CG-1 | 0.8 | HT-1 | 29.35 | ET-1 | 29.35 | NR-1 | 40 | BR-8 | 0 | | |
| Exper. Ex. 43 | | 0.8 | | 29.29 | | 29.29 | | 40 | | 0.12 | | |
| Exper. Ex. 44 | | 1 | | 31.96 | | 21.31 | | 45 | | 0.23 | | |
| Exper. Ex. 45 | | 1.2 | | 31.87 | | 15.93 | | 50 | | 0.5 | | |
| Exper. Ex. 46 | | 1.5 | | 29.34 | | 11.73 | | 55 | BR-9 | 1.93 | | |
| Exper. Ex. 47 | | 1.8 | | 25.58 | | 8.53 | | 60 | | 3.6 | | |
| Exper. Ex. 48 | | 1.8 | | 23.63 | | 8.87 | | 60 | | 6.2 | | |

TABLE 3

| | Charge generation material | | Hole transport material | | Electron transport material | | Binder resin | | Highly branched polymer | | Additive content | |
|---|---|---|---|---|---|---|---|---|---|---|---|---|
| | Material | Content | Material | Content | Material | Content | Material | Content | Material | Content | BHT | KF56 |
| Conv. Ex. 9 | CG-2 | 0.8 | HT-1 | 29.35 | ET-1 | 29.35 | NR-1 | 40 | BR-1 | 0 | 0.49 | 0.01 |
| Exper. Ex. 49 | | 0.8 | | 29.29 | | 29.29 | | 40 | | 0.12 | | |
| Exper. Ex. 50 | | 1 | | 31.96 | | 21.31 | | 45 | | 0.23 | | |
| Exper. Ex. 51 | | 1.2 | | 31.87 | | 15.93 | | 50 | | 0.5 | | |
| Exper. Ex. 52 | | 1.5 | | 29.34 | | 11.73 | | 55 | | 1.93 | | |
| Exper. Ex. 53 | | 1.8 | | 25.58 | | 8.53 | | 60 | | 3.6 | | |
| Exper. Ex. 54 | | 1.8 | | 23.63 | | 8.87 | | 60 | | 6.2 | | |
| Conv. Ex. 10 | CG-2 | 0.8 | HT-2 | 29.35 | ET-1 | 29.35 | NR-1 | 40 | BR-1 | 0 | | |
| Exper. Ex. 55 | | 0.8 | | 29.29 | | 29.29 | | 40 | | 0.12 | | |
| Exper. Ex. 56 | | 1 | | 31.96 | | 21.31 | | 45 | | 0.23 | | |
| Exper. Ex. 57 | | 1.2 | | 31.87 | | 15.93 | | 50 | | 0.5 | | |
| Exper. Ex. 58 | | 1.5 | HT-3 | 29.34 | | 11.73 | | 55 | | 1.93 | | |
| Exper. Ex. 59 | | 1.8 | | 25.58 | | 8.53 | | 60 | | 3.6 | | |
| Exper. Ex. 60 | | 1.8 | | 23.63 | | 8.87 | | 60 | | 6.2 | | |
| Conv. Ex. 11 | CG-2 | 0.8 | HT-1 | 29.35 | ET-2 | 29.35 | NR-1 | 40 | BR-1 | 0 | | |
| Exper. Ex. 61 | | 0.8 | | 29.29 | | 29.29 | | 40 | | 0.12 | | |
| Exper. Ex. 62 | | 1 | | 31.96 | | 21.31 | | 45 | | 0.23 | | |
| Exper. Ex. 63 | | 1.2 | | 31.87 | | 15.93 | | 50 | | 0.5 | | |
| Exper. Ex. 64 | | 1.5 | | 29.34 | ET-3 | 11.73 | | 55 | | 1.93 | | |
| Exper. Ex. 65 | | 1.8 | | 25.58 | | 8.53 | | 60 | | 3.6 | | |
| Exper. Ex. 66 | | 1.8 | | 23.63 | | 8.87 | | 60 | | 6.2 | | |
| Conv. Ex. 12 | CG-2 | 0.8 | HT-1 | 29.35 | ET-1 | 29.35 | NR-2 | 40 | BR-1 | 0 | | |
| Exper. Ex. 67 | | 0.8 | | 29.29 | | 29.29 | | 40 | | 0.12 | | |

TABLE 3-continued

| | Charge generation material | | Hole transport material | | Electron transport material | | Binder resin | | Highly branched polymer | | Additive content | |
|---|---|---|---|---|---|---|---|---|---|---|---|---|
| | Material | Content | Material | Content | Material | Content | Material | Content | Material | Content | BHT | KF56 |
| Exper. Ex. 68 | | 1 | | 31.96 | | 21.31 | | 45 | | 0.23 | | |
| Exper. Ex. 69 | | 1.2 | | 31.87 | | 15.93 | | 50 | | 0.5 | | |
| Exper. Ex. 70 | | 1.5 | | 29.34 | | 11.73 | NR-3 | 55 | | 1.93 | | |
| Exper. Ex. 71 | | 1.8 | | 25.58 | | 8.53 | | 60 | | 3.6 | | |
| Exper. Ex. 72 | | 1.8 | | 23.63 | | 8.87 | | 60 | | 6.2 | | |
| Conv. Ex. 13 | CG-2 | 0.8 | HT-1 | 29.35 | ET-1 | 29.35 | NR-1 | 40 | BR-2 | 0 | | |
| Exper. Ex. 73 | | 0.8 | | 29.29 | | 29.29 | | 40 | | 0.12 | | |
| Exper. Ex. 74 | | 1 | | 31.96 | | 21.31 | | 45 | | 0.23 | | |
| Exper. Ex. 75 | | 1.2 | | 31.87 | | 15.93 | | 50 | | 0.5 | | |
| Exper. Ex. 76 | | 1.5 | | 29.34 | | 11.73 | | 55 | BR-3 | 1.93 | | |
| Exper. Ex. 77 | | 1.8 | | 25.58 | | 8.53 | | 60 | | 3.6 | | |
| Exper. Ex. 78 | | 1.8 | | 23.63 | | 8.87 | | 60 | | 6.2 | | |
| Conv. Ex. 14 | CG-2 | 0.8 | HT-1 | 29.35 | ET-1 | 29.35 | NR-1 | 40 | BR-4 | 0 | | |
| Exper. Ex. 79 | | 0.8 | | 29.29 | | 29.29 | | 40 | | 0.12 | | |
| Exper. Ex. 80 | | 1 | | 31.96 | | 21.31 | | 45 | | 0.23 | | |
| Exper. Ex. 81 | | 1.2 | | 31.87 | | 15.93 | | 50 | | 0.5 | | |
| Exper. Ex. 82 | | 1.5 | | 29.34 | | 11.73 | | 55 | BR-5 | 1.93 | | |
| Exper. Ex. 83 | | 1.3 | | 25.58 | | 8.53 | | 60 | | 3.6 | | |
| Exper. Ex. 84 | | 1.8 | | 23.63 | | 8.87 | | 60 | | 6.2 | | |
| Conv. Ex. 15 | CG-2 | 0.8 | HT-1 | 29.35 | ET-1 | 29.35 | NR-1 | 40 | BR-6 | 0 | | |
| Exper. Ex. 85 | | 0.8 | | 29.29 | | 29.29 | | 40 | | 0.12 | | |
| Exper. Ex. 86 | | 1 | | 31.96 | | 21.31 | | 45 | | 0.23 | | |
| Exper. Ex. 87 | | 1.2 | | 31.87 | | 15.93 | | 50 | | 0.5 | | |
| Exper. Ex. 88 | | 1.5 | | 29.34 | | 11.73 | | 55 | BR-7 | 1.93 | | |
| Exper. Ex. 89 | | 1.8 | | 25.58 | | 8.53 | | 60 | | 3.6 | | |
| Exper. Ex. 90 | | 1.8 | | 23.63 | | 8.87 | | 60 | | 6.2 | | |
| Conv. Ex. 16 | CG-2 | 0.8 | HT-1 | 29.35 | ET-1 | 29.35 | NR-1 | 40 | BR-8 | 0 | | |
| Exper. Ex. 91 | | 0.8 | | 29.29 | | 29.29 | | 40 | | 0.12 | | |
| Exper. Ex. 92 | | 1 | | 31.96 | | 21.31 | | 45 | | 0.23 | | |
| Exper. Ex. 93 | | 1.2 | | 31.87 | | 15.93 | | 50 | | 0.5 | | |
| Exper. Ex. 94 | | 1.5 | | 29.34 | | 11.73 | | 55 | BR-9 | 1.93 | | |
| Exper. Ex. 95 | | 1.8 | | 25.58 | | 8.53 | | 60 | | 3.6 | | |
| Exper. Ex. 96 | | 1.8 | | 23.63 | | 8.87 | | 60 | | 6.2 | | |

TABLE 4

| | Charge transport layer | Charge generation material | | Hole transport material | | Electron transport material | | Binder resin | | Highly branched polymer | | Additive content | |
|---|---|---|---|---|---|---|---|---|---|---|---|---|---|
| | | Material | Content | Material | Content | Material | Content | Material | Content | Material | Content | BHT | KF56 |
| Conv. Ex. 17 | CT-1 | CG-1 | 1.5 | HT-1 | 46.4 | ET-1 | 11.6 | NR-1 | 40 | BR-1 | 0 | 0.49 | 0.01 |
| Exper. Ex. 97 | | | 1.5 | | 46.3 | | 11.58 | | 40 | | 0.12 | | |
| Exper. Ex. 98 | | | 1.9 | | 39.28 | | 13.09 | | 45 | | 0.23 | | |
| Exper. Ex. 99 | | | 2.3 | | 32.69 | | 14.01 | | 50 | | 0.5 | | |
| Exper. Ex. 100 | | | 2.7 | | 25.92 | | 13.95 | | 55 | | 1.93 | | |
| Exper. Ex. 101 | | | 3 | | 19.74 | | 13.16 | | 60 | | 3.6 | | |
| Exper. Ex. 102 | | | 3 | | 18.18 | | 12.12 | | 60 | | 6.2 | | |
| Conv. Ex. 18 | CT-1 | CG-1 | 1.5 | HT-2 | 46.4 | ET-1 | 11.6 | NR-1 | 40 | BR-1 | 0 | | |
| Exper. Ex. 103 | | | 1.5 | | 46.3 | | 11.58 | | 40 | | 0.12 | | |
| Exper. Ex. 104 | | | 1.9 | | 39.28 | | 13.09 | | 45 | | 0.23 | | |
| Exper. Ex. 105 | | | 2.3 | | 32.69 | | 14.01 | | 50 | | 0.5 | | |
| Exper. Ex. 106 | | | 2.7 | HT-3 | 25.92 | | 13.95 | | 55 | | 1.93 | | |
| Exper. Ex. 107 | | | 3 | | 19.74 | | 13.16 | | 60 | | 3.6 | | |
| Exper. Ex. 108 | | | 3 | | 18.18 | | 12.12 | | 60 | | 6.2 | | |
| Conv. example. 19 | CT-1 | CG-1 | 1.5 | HT-1 | 46.4 | ET-2 | 11.6 | NR-1 | 40 | BR-1 | 0 | | |
| Exper. Ex. 109 | | | 1.5 | | 46.3 | | 11.58 | | 40 | | 0.12 | | |
| Exper. Ex. 110 | | | 1.9 | | 39.28 | | 13.09 | | 45 | | 0.23 | | |
| Exper. Ex. 111 | | | 2.3 | | 32.69 | | 14.01 | | 50 | | 0.5 | | |
| Exper. Ex. 112 | | | 2.7 | | 25.92 | ET-3 | 13.95 | | 55 | | 1.93 | | |
| Exper. Ex. 113 | | | 3 | | 19.74 | | 13.16 | | 60 | | 3.6 | | |
| Exper. Ex. 114 | | | 3 | | 18.18 | | 12.12 | | 60 | | 6.2 | | |
| Conv. Ex. 20 | CT-1 | CG-1 | 1.5 | HT-1 | 46.4 | ET-1 | 11.6 | NR-2 | 40 | BR-1 | 0 | | |
| Exper. Ex. 115 | | | 1.5 | | 46.3 | | 11.58 | | 40 | | 0.12 | | |
| Exper. Ex. 116 | | | 1.9 | | 39.28 | | 13.09 | | 45 | | 0.23 | | |
| Exper. Ex. 117 | | | 2.3 | | 32.69 | | 14.01 | | 50 | | 0.5 | | |
| Exper. Ex. 118 | | | 2.7 | | 25.92 | | 13.95 | NR-3 | 55 | | 1.93 | | |
| Exper. Ex. 119 | | | 3 | | 19.74 | | 13.16 | | 60 | | 3.6 | | |
| Exper. Ex. 120 | | | 3 | | 18.18 | | 12.12 | | 60 | | 6.2 | | |
| Conv. ex 21 | CT-2 | CG-1 | 1.5 | HT-1 | 46.4 | ET-1 | 11.6 | NR-1 | 40 | BR-2 | 0 | | |
| Exper. Ex. 121 | | | 1.5 | | 46.3 | | 11.58 | | 40 | | 0.12 | | |
| Exper. Ex. 122 | | | 1.9 | | 39.28 | | 13.09 | | 45 | | 0.23 | | |

TABLE 4-continued

| | Charge transport layer | Charge generation material | | Hole transport material | | Electron transport material | | Binder resin | | Highly branched polymer | | Additive content | |
|---|---|---|---|---|---|---|---|---|---|---|---|---|---|
| | | Material | Content | Material | Content | Material | Content | Material | Content | Material | Content | BHT | KF56 |
| Exper. Ex. 123 | | | 2.3 | | 32.69 | | 14.01 | | 50 | | 0.5 | | |
| Exper. Ex. 124 | | | 2.7 | | 25.92 | | 13.95 | | 55 | BR-3 | 1.93 | | |
| Exper. Ex. 125 | | | 3 | | 19.74 | | 13.16 | | 60 | | 3.6 | | |
| Exper. Ex. 126 | | | 3 | | 18.18 | | 12.12 | | 60 | | 6.2 | | |
| Conv. Ex. 22 | CT-2 | CG-1 | 1.5 | HT-1 | 46.4 | ET-1 | 11.6 | NR-1 | 40 | BR-4 | 0 | | |
| Exper. Ex. 127 | | | 1.5 | | 46.3 | | 11.58 | | 40 | | 0.12 | | |
| Exper. Ex. 128 | | | 1.9 | | 39.28 | | 13.09 | | 45 | | 0.23 | | |
| Exper. Ex. 129 | | | 2.3 | | 32.69 | | 14.01 | | 50 | | 0.5 | | |
| Exper. Ex. 130 | | | 2.7 | | 25.92 | | 13.95 | | 55 | BR-5 | 1.93 | | |
| Exper. Ex. 131 | | | 3 | | 19.74 | | 13.16 | | 60 | | 3.6 | | |
| Exper. Ex. 132 | | | 3 | | 18.18 | | 12.12 | | 60 | | 6.2 | | |
| Conv. Ex. 23 | CT-3 | CG-1 | 1.5 | HT-1 | 46.4 | ET-1 | 11.6 | NR-1 | 40 | BR-6 | 0 | | |
| Exper. Ex. 133 | | | 1.5 | | 46.3 | | 11.58 | | 40 | | 0.12 | | |
| Exper. Ex. 134 | | | 1.9 | | 39.28 | | 13.09 | | 45 | | 0.23 | | |
| Exper. Ex. 135 | | | 2.3 | | 32.69 | | 14.01 | | 50 | | 0.5 | | |
| Exper. Ex. 136 | | | 2.7 | | 25.92 | | 13.95 | | 55 | BR-7 | 1.93 | | |
| Exper. Ex. 137 | | | 3 | | 19.74 | | 13.16 | | 60 | | 3.6 | | |
| Exper. Ex. 138 | | | 3 | | 18.18 | | 12.12 | | 60 | | 6.2 | | |
| Conv. Ex. 24 | CT-3 | CG-1 | 1.5 | HT-1 | 46.4 | ET-1 | 11.6 | NR-1 | 40 | BR-8 | 0 | | |
| Exper. Ex. 139 | | | 1.5 | | 46.3 | | 11.58 | | 40 | | 0.12 | | |
| Exper. Ex. 140 | | | 1.9 | | 39.28 | | 13.09 | | 45 | | 0.23 | | |
| Exper. Ex. 141 | | | 2.3 | | 32.69 | | 14.01 | | 50 | | 0.5 | | |
| Exper. Ex. 142 | | | 2.7 | | 25.92 | | 13.95 | | 55 | BR-9 | 1.93 | | |
| Exper. Ex. 143 | | | 3 | | 19.74 | | 13.16 | | 60 | | 3.6 | | |
| Exper. Ex. 144 | | | 3 | | 18.18 | | 12.12 | | 60 | | 6.2 | | |

TABLE 5

| | Charge transport layer | Charge generation material | | Hole transport material | | Electron transport material | | Binder resin | | Highly branched polymer | | Additive content | |
|---|---|---|---|---|---|---|---|---|---|---|---|---|---|
| | | Material | Content | Material | Content | Material | Content | Material | Content | Material | Content | BHT | KF56 |
| Conv. Ex. 25 | CT-1 | CG-2 | 1.5 | HT-1 | 46.4 | ET-1 | 11.6 | NR-1 | 40 | BR-1 | 0 | 0.49 | 0.01 |
| Exper. Ex. 145 | | | 1.5 | | 46.3 | | 11.58 | | 40 | | 0.12 | | |
| Exper. Ex. 146 | | | 1.9 | | 39.28 | | 13.09 | | 45 | | 0.23 | | |
| Exper. Ex. 147 | | | 2.3 | | 32.69 | | 14.01 | | 50 | | 0.5 | | |
| Exper. Ex. 148 | | | 2.7 | | 25.92 | | 13.95 | | 55 | | 1.93 | | |
| Exper. Ex. 149 | | | 3 | | 19.74 | | 13.16 | | 60 | | 3.6 | | |
| Exper. Ex. 150 | | | 3 | | 18.18 | | 12.12 | | 60 | | 6.2 | | |
| Conv. Ex. 26 | CT-1 | CG-2 | 1.5 | HT-2 | 46.4 | ET-1 | 11.6 | NR-1 | 40 | BR-1 | 0 | | |
| Exper. Ex. 151 | | | 1.5 | | 46.3 | | 11.58 | | 40 | | 0.12 | | |
| Exper. Ex. 152 | | | 1.9 | | 39.28 | | 13.09 | | 45 | | 0.23 | | |
| Exper. Ex. 153 | | | 2.3 | | 32.69 | | 14.01 | | 50 | | 0.5 | | |
| Exper. Ex. 154 | | | 2.7 | HT-3 | 25.92 | | 13.95 | | 55 | | 1.93 | | |
| Exper. Ex. 155 | | | 3 | | 19.74 | | 13.16 | | 60 | | 3.6 | | |
| Exper. Ex. 156 | | | 3 | | 18.18 | | 12.12 | | 60 | | 6.2 | | |
| Conv. Ex. 27 | CT-1 | CG-2 | 1.5 | HT-1 | 46.4 | ET-2 | 11.6 | NR-1 | 40 | BR-1 | 0 | | |
| Exper. Ex. 157 | | | 1.5 | | 46.3 | | 11.58 | | 40 | | 0.12 | | |
| Exper. Ex. 158 | | | 1.9 | | 39.28 | | 13.09 | | 45 | | 0.23 | | |
| Exper. Ex. 159 | | | 2.3 | | 32.69 | | 14.01 | | 50 | | 0.5 | | |
| Exper. Ex. 160 | | | 2.7 | | 25.92 | ET-3 | 13.95 | | 55 | | 1.93 | | |
| Exper. Ex. 161 | | | 3 | | 19.74 | | 13.16 | | 60 | | 3.6 | | |
| Exper. Ex. 162 | | | 3 | | 18.18 | | 12.12 | | 60 | | 6.2 | | |
| Conv. Ex. 28 | CT-1 | CG-2 | 1.5 | HT-1 | 46.4 | ET-1 | 11.6 | NR-2 | 40 | BR-1 | 0 | | |
| Exper. Ex. 163 | | | 1.5 | | 46.3 | | 11.58 | | 40 | | 0.12 | | |
| Exper. Ex. 164 | | | 1.9 | | 39.28 | | 13.09 | | 45 | | 0.23 | | |
| Exper. Ex. 165 | | | 2.3 | | 32.69 | | 14.01 | | 50 | | 0.5 | | |
| Exper. Ex. 166 | | | 2.7 | | 25.92 | | 13.95 | NR-3 | 55 | | 1.93 | | |
| Exper. Ex. 167 | | | 3 | | 19.74 | | 13.16 | | 60 | | 3.6 | | |
| Exper. Ex. 168 | | | 3 | | 18.18 | | 12.12 | | 60 | | 6.2 | | |
| Conv. Ex. 29 | CT-2 | CG-2 | 1.5 | HT-1 | 46.4 | ET-1 | 11.3 | NR-1 | 40 | BR-2 | 0 | | |
| Exper. Ex. 169 | | | 1.5 | | 46.3 | | 11.58 | | 40 | | 0.12 | | |
| Exper. Ex. 170 | | | 1.9 | | 39.28 | | 13.09 | | 45 | | 0.23 | | |
| Exper. Ex. 171 | | | 2.3 | | 32.69 | | 14.01 | | 50 | | 0.5 | | |
| Exper. Ex. 172 | | | 2.7 | | 25.92 | | 13.95 | | 55 | BR-3 | 1.93 | | |
| Exper. Ex. 173 | | | 3 | | 19.74 | | 13.16 | | 60 | | 3.6 | | |
| Exper. Ex. 174 | | | 3 | | 18.18 | | 12.12 | | 60 | | 6.2 | | |
| Conv. Ex. 30 | CT-2 | CG-2 | 1.5 | HT-1 | 46.4 | ET-1 | 11.6 | NR-1 | 40 | BR-4 | 0 | | |
| Exper. Ex. 175 | | | 1.5 | | 46.3 | | 11.58 | | 40 | | 0.12 | | |
| Exper. Ex. 176 | | | 1.9 | | 39.28 | | 13.09 | | 45 | | 0.23 | | |
| Exper. Ex. 177 | | | 2.3 | | 32.69 | | 14.01 | | 50 | | 0.5 | | |

TABLE 5-continued

| | Charge transport layer | Charge generation material | | Hole transport material | | Electron transport material | | Binder resin | | Highly branched polymer | | Additive content | |
|---|---|---|---|---|---|---|---|---|---|---|---|---|---|
| | | Material | Content | Material | Content | Material | Content | Material | Content | Material | Content | BHT | KF56 |
| Exper. Ex. 178 | | | 2.7 | | 25.92 | | 13.95 | | 55 | BR-5 | 1.93 | | |
| Exper. Ex. 179 | | | 3 | | 19.74 | | 13.16 | | 60 | | 3.6 | | |
| Exper. Ex. 180 | | | 3 | | 18.18 | | 12.12 | | 60 | | 6.2 | | |
| Conv. Ex. 31 | CT-3 | CG-2 | 1.5 | HT-1 | 46.4 | ET-1 | 11.6 | NR-1 | 40 | BR-6 | 0 | | |
| Exper. Ex. 181 | | | 1.5 | | 46.3 | | 11.58 | | 40 | | 0.12 | | |
| Exper. Ex. 182 | | | 1.9 | | 39.28 | | 13.09 | | 45 | | 0.23 | | |
| Exper. Ex. 183 | | | 2.3 | | 32.69 | | 14.01 | | 50 | | 0.5 | | |
| Exper. Ex. 184 | | | 2.7 | | 25.92 | | 13.95 | | 55 | BR-7 | 1.93 | | |
| Exper. Ex. 185 | | | 3 | | 19.74 | | 13.16 | | 60 | | 3.6 | | |
| Exper. Ex. 186 | | | 3 | | 18.18 | | 12.12 | | 60 | | 6.2 | | |
| Conv. Ex. 32 | CT-3 | CG-2 | 1.5 | HT-1 | 46.4 | ET-1 | 11.6 | NR-1 | 40 | BR-8 | 0 | | |
| Exper. Ex. 187 | | | 1.5 | | 46.3 | | 11.58 | | 40 | | 0.12 | | |
| Exper. Ex. 188 | | | 1.9 | | 39.28 | | 13.09 | | 45 | | 0.23 | | |
| Exper. Ex. 189 | | | 2.3 | | 32.69 | | 14.01 | | 50 | | 0.5 | | |
| Exper. Ex. 190 | | | 2.7 | | 25.92 | | 13.95 | | 55 | BR-9 | 1.93 | | |
| Exper. Ex. 191 | | | 3 | | 19.74 | | 13.16 | | 60 | | 3.6 | | |
| Exper. Ex. 192 | | | 3 | | 18.18 | | 12.12 | | 60 | | 6.2 | | |

TABLE 6

| | Electrical characteristic Fatigue | Appearance characteristic Smoothness | Contamination characteristic Black spots/white spots |
|---|---|---|---|
| Conv. Ex. 1 | ○ | ○ | x |
| Exper. Ex. 1 | ○ | ○ | Δ |
| Exper. Ex. 2 | ○ | ○ | ○ |
| Exper. Ex. 3 | ○ | ○ | ○ |
| Exper. Ex. 4 | ○ | ○ | ○ |
| Exper. Ex. 5 | Δ | Δ | ○ |
| Exper. Ex. 6 | x | x | ○ |
| Conv. Ex. 2 | ○ | ○ | x |
| Exper. Ex. 7 | ○ | ○ | Δ |
| Exper. Ex. 8 | ○ | ○ | ○ |
| Exper. Ex. 9 | ○ | ○ | ○ |
| Exper. Ex. 10 | ○ | ○ | ○ |
| Exper. Ex. 11 | Δ | Δ | ○ |
| Exper. Ex. 12 | x | x | ○ |
| Conv. Ex. 3 | ○ | ○ | x |
| Exper. Ex. 13 | ○ | ○ | Δ |
| Exper. Ex. 14 | ○ | ○ | ○ |
| Exper. Ex. 15 | ○ | ○ | ○ |
| Exper. Ex. 16 | ○ | ○ | ○ |
| Exper. Ex. 17 | Δ | Δ | ○ |
| Exper. Ex. 18 | x | x | ○ |
| Conv. Ex. 4 | ○ | ○ | x |
| Exper. Ex. 19 | ○ | ○ | Δ |
| Exper. Ex. 20 | ○ | ○ | ○ |
| Exper. Ex. 21 | ○ | ○ | ○ |
| Exper. Ex. 22 | ○ | ○ | ○ |
| Exper. Ex. 23 | Δ | Δ | ○ |
| Exper. Ex. 24 | x | x | ○ |
| Conv. Ex. 5 | ○ | ○ | x |
| Exper. Ex. 25 | ○ | ○ | Δ |
| Exper. Ex. 26 | ○ | ○ | ○ |
| Exper. Ex. 27 | ○ | ○ | ○ |
| Exper. Ex. 28 | ○ | ○ | ○ |
| Exper. Ex. 29 | Δ | Δ | ○ |
| Exper. Ex. 30 | x | x | ○ |
| Conv. Ex. 6 | ○ | ○ | x |
| Exper. Ex. 31 | ○ | ○ | Δ |
| Exper. Ex. 32 | ○ | ○ | ○ |
| Exper. Ex. 33 | ○ | ○ | ○ |
| Exper. Ex. 34 | ○ | ○ | ○ |
| Exper. Ex. 35 | Δ | Δ | ○ |
| Exper. Ex. 36 | x | x | ○ |
| Conv. Ex. 7 | ○ | ○ | x |
| Exper. Ex. 37 | ○ | ○ | Δ |
| Exper. Ex. 38 | ○ | ○ | ○ |
| Exper. Ex. 39 | ○ | ○ | ○ |
| Exper. Ex. 40 | ○ | ○ | ○ |
| Exper. Ex. 41 | Δ | Δ | ○ |
| Exper. Ex. 42 | x | x | ○ |

TABLE 6-continued

| | Electrical characteristic Fatigue | Appearance characteristic Smoothness | Contamination characteristic Black spots/white spots |
|---|---|---|---|
| Conv. Ex. 8 | ○ | ○ | x |
| Exper. Ex. 43 | ○ | ○ | Δ |
| Exper. Ex. 44 | ○ | ○ | ○ |
| Exper. Ex. 45 | ○ | ○ | ○ |
| Exper. Ex. 46 | ○ | ○ | ○ |
| Exper. Ex. 47 | Δ | Δ | ○ |
| Exper. Ex. 48 | x | x | ○ |

TABLE 7

| | Electrical characteristic Fatigue | Appearance characteristic Smoothness | Contamination characteristic Black spots/white spots |
|---|---|---|---|
| Conv. Ex. 9 | ○ | ○ | x |
| Exper. Ex. 49 | ○ | ○ | Δ |
| Exper. Ex. 50 | ○ | ○ | ○ |
| Exper. Ex. 51 | ○ | ○ | ○ |
| Exper. Ex. 52 | ○ | ○ | ○ |
| Exper. Ex. 53 | Δ | Δ | ○ |
| Exper. Ex. 54 | x | x | ○ |
| Conv. Ex. 10 | ○ | ○ | x |
| Exper. Ex. 55 | ○ | ○ | Δ |
| Exper. Ex. 56 | ○ | ○ | ○ |
| Exper. Ex. 57 | ○ | ○ | ○ |
| Exper. Ex. 58 | ○ | ○ | ○ |
| Exper. Ex. 59 | Δ | Δ | ○ |
| Exper. Ex. 60 | x | x | ○ |
| Conv. Ex. 11 | ○ | ○ | x |
| Exper. Ex. 61 | ○ | ○ | Δ |
| Exper. Ex. 62 | ○ | ○ | ○ |
| Exper. Ex. 63 | ○ | ○ | ○ |
| Exper. Ex. 64 | ○ | ○ | ○ |
| Exper. Ex. 65 | Δ | Δ | ○ |
| Exper. Ex. 66 | x | x | ○ |
| Conv. Ex. 12 | ○ | ○ | x |
| Exper. Ex. 67 | ○ | ○ | Δ |
| Exper. Ex. 68 | ○ | ○ | ○ |
| Exper. Ex. 69 | ○ | ○ | ○ |
| Exper. Ex. 70 | ○ | ○ | ○ |
| Exper. Ex. 71 | Δ | Δ | ○ |
| Exper. Ex. 72 | x | x | ○ |
| Conv. Ex. 13 | ○ | ○ | x |
| Exper. Ex. 73 | ○ | ○ | Δ |
| Exper. Ex. 74 | ○ | ○ | ○ |
| Exper. Ex. 75 | ○ | ○ | ○ |
| Exper. Ex. 76 | ○ | ○ | ○ |
| Exper. Ex. 77 | Δ | Δ | ○ |
| Exper. Ex. 78 | x | x | ○ |
| Conv. Ex. 14 | ○ | ○ | x |
| Exper. Ex. 79 | ○ | ○ | Δ |
| Exper. Ex. 80 | ○ | ○ | ○ |
| Exper. Ex. 81 | ○ | ○ | ○ |
| Exper. Ex. 82 | ○ | ○ | ○ |
| Exper. Ex. 83 | Δ | Δ | ○ |
| Exper. Ex. 84 | x | x | ○ |
| Conv. Ex. 15 | ○ | ○ | x |
| Exper. Ex. 85 | ○ | ○ | Δ |
| Exper. Ex. 86 | ○ | ○ | ○ |
| Exper. Ex. 87 | ○ | ○ | ○ |
| Exper. Ex. 88 | ○ | ○ | ○ |
| Exper. Ex. 89 | Δ | Δ | ○ |
| Exper. Ex. 90 | x | x | ○ |
| Conv. Ex. 16 | ○ | ○ | x |
| Exper. Ex. 91 | ○ | ○ | Δ |
| Exper. Ex. 92 | ○ | ○ | ○ |
| Exper. Ex. 93 | ○ | ○ | ○ |
| Exper. Ex. 94 | ○ | ○ | ○ |
| Exper. Ex. 95 | Δ | Δ | ○ |
| Exper. Ex. 96 | x | x | ○ |

TABLE 8

| | Electrical characteristic Fatigue | Appearance characteristic Smoothness | Contamination characteristic Black spots/white spots |
|---|---|---|---|
| Conv. Ex. 17 | ○ | ○ | x |
| Exper. Ex. 97 | ○ | ○ | Δ |
| Exper. Ex. 98 | ○ | ○ | ○ |
| Exper. Ex. 99 | ○ | ○ | ○ |
| Exper. Ex. 100 | ○ | ○ | ○ |
| Exper. Ex. 101 | Δ | Δ | ○ |
| Exper. Ex. 102 | x | x | ○ |
| Conv. Ex. 18 | ○ | ○ | x |
| Exper. Ex. 103 | ○ | ○ | Δ |
| Exper. Ex. 104 | ○ | ○ | ○ |
| Exper. Ex. 105 | ○ | ○ | ○ |
| Exper. Ex. 106 | ○ | ○ | ○ |
| Exper. Ex. 107 | Δ | Δ | ○ |
| Exper. Ex. 108 | x | x | ○ |
| Conv. Ex. 19 | ○ | ○ | x |
| Exper. Ex. 109 | ○ | ○ | Δ |
| Exper. Ex. 110 | ○ | ○ | ○ |
| Exper. Ex. 111 | ○ | ○ | ○ |
| Exper. Ex. 112 | ○ | ○ | ○ |
| Exper. Ex. 113 | Δ | Δ | ○ |
| Exper. Ex. 114 | x | x | ○ |
| Conv. Ex. 20 | ○ | ○ | x |
| Exper. Ex. 115 | ○ | ○ | Δ |
| Exper. Ex. 116 | ○ | ○ | ○ |
| Exper. Ex. 117 | ○ | ○ | ○ |
| Exper. Ex. 118 | ○ | ○ | ○ |
| Exper. Ex. 119 | Δ | Δ | ○ |
| Exper. Ex. 120 | x | x | ○ |
| Conv. Ex. 21 | ○ | ○ | x |
| Exper. Ex. 121 | ○ | ○ | Δ |
| Exper. Ex. 122 | ○ | ○ | ○ |
| Exper. Ex. 123 | ○ | ○ | ○ |
| Exper. Ex. 124 | ○ | ○ | ○ |
| Exper. Ex. 125 | Δ | Δ | ○ |
| Exper. Ex. 126 | x | x | ○ |
| Conv. Ex. 22 | ○ | ○ | x |
| Exper. Ex. 127 | ○ | ○ | Δ |
| Exper. Ex. 128 | ○ | ○ | ○ |
| Exper. Ex. 129 | ○ | ○ | ○ |
| Exper. Ex. 130 | ○ | ○ | ○ |
| Exper. Ex. 131 | Δ | Δ | ○ |
| Exper. Ex. 132 | x | x | ○ |
| Conv. Ex. 23 | ○ | ○ | x |
| Exper. Ex. 133 | ○ | ○ | Δ |
| Exper. Ex. 134 | ○ | ○ | ○ |
| Exper. Ex. 135 | ○ | ○ | ○ |
| Exper. Ex. 136 | ○ | ○ | ○ |
| Exper. Ex. 137 | Δ | Δ | ○ |
| Exper. Ex. 138 | x | x | ○ |
| Conv. Ex. 24 | ○ | ○ | x |
| Exper. Ex. 139 | ○ | ○ | Δ |
| Exper. Ex. 140 | ○ | ○ | ○ |
| Exper. Ex. 141 | ○ | ○ | ○ |
| Exper. Ex. 142 | ○ | ○ | ○ |
| Exper. Ex. 143 | Δ | Δ | ○ |
| Exper. Ex. 144 | x | x | ○ |

TABLE 9

| | Electrical characteristic Fatigue | Appearance characteristic Smoothness | Contamination characteristic Black spots/white spots |
|---|---|---|---|
| Conv. Ex. 25 | ○ | ○ | x |
| Exper. Ex. 145 | ○ | ○ | Δ |
| Exper. Ex. 146 | ○ | ○ | ○ |
| Exper. Ex. 147 | ○ | ○ | ○ |
| Exper. Ex. 148 | ○ | ○ | ○ |
| Exper. Ex. 149 | Δ | Δ | ○ |

TABLE 9-continued

| | Electrical characteristic Fatigue | Appearance characteristic Smoothness | Contamination characteristic Black spots/white spots |
|---|---|---|---|
| Exper. Ex. 150 | x | x | ○ |
| Conv. Ex. 26 | ○ | ○ | x |
| Exper. Ex. 151 | ○ | ○ | Δ |
| Exper. Ex. 152 | ○ | ○ | ○ |
| Exper. Ex. 153 | ○ | ○ | ○ |
| Exper. Ex. 154 | ○ | ○ | ○ |
| Exper. Ex. 155 | Δ | Δ | ○ |
| Exper. Ex. 156 | x | x | ○ |
| Conv. Ex. 27 | ○ | ○ | x |
| Exper. Ex. 157 | ○ | ○ | Δ |
| Exper. Ex. 158 | ○ | ○ | ○ |
| Exper. Ex. 159 | ○ | ○ | ○ |
| Exper. Ex. 160 | ○ | ○ | ○ |
| Exper. Ex. 161 | Δ | Δ | ○ |
| Exper. Ex. 162 | x | x | ○ |
| Conv. Ex. 28 | ○ | ○ | x |
| Exper. Ex. 163 | ○ | ○ | Δ |
| Exper. Ex. 164 | ○ | ○ | ○ |
| Exper. Ex. 165 | ○ | ○ | ○ |
| Exper. Ex. 166 | ○ | ○ | ○ |
| Exper. Ex. 167 | Δ | Δ | ○ |
| Exper. Ex. 168 | x | x | ○ |
| Conv. Ex. 29 | ○ | ○ | x |
| Exper. Ex. 169 | ○ | ○ | Δ |
| Exper. Ex. 170 | ○ | ○ | ○ |
| Exper. Ex. 171 | ○ | ○ | ○ |
| Exper. Ex. 172 | ○ | ○ | ○ |
| Exper. Ex. 173 | Δ | Δ | ○ |
| Exper. Ex. 174 | x | x | ○ |
| Conv. Ex. 30 | ○ | ○ | x |
| Exper. Ex. 175 | ○ | ○ | Δ |
| Exper. Ex. 176 | ○ | ○ | ○ |
| Exper. Ex. 177 | ○ | ○ | ○ |
| Exper. Ex. 178 | ○ | ○ | ○ |
| Exper. Ex. 179 | Δ | Δ | ○ |
| Exper. Ex. 180 | x | x | ○ |
| Conv. Ex. 31 | ○ | ○ | x |
| Exper. Ex. 181 | ○ | ○ | Δ |
| Exper. Ex. 182 | ○ | ○ | ○ |
| Exper. Ex. 183 | ○ | ○ | ○ |
| Exper. Ex. 184 | ○ | ○ | ○ |
| Exper. Ex. 185 | Δ | Δ | ○ |
| Exper. Ex. 186 | x | x | ○ |
| Conv. Ex. 32 | ○ | ○ | x |
| Exper. Ex. 187 | ○ | ○ | Δ |
| Exper. Ex. 188 | ○ | ○ | ○ |
| Exper. Ex. 189 | ○ | ○ | ○ |
| Exper. Ex. 190 | ○ | ○ | ○ |
| Exper. Ex. 191 | Δ | Δ | ○ |
| Exper. Ex. 192 | x | x | ○ |

The results of the tables reveal that incorporating a highly branched polymer having a specific structure into the outermost layer allows effectively suppressing the occurrence of image defects due to cracks derived from adhesion of sebum. Further, it was found that setting the content of highly branched polymer to lie within a predetermined amount range with respect to the binder resin in respective layers made it possible to achieve good levels of other electrical characteristics, and quality of appearance.

From the above results it follows that the present invention allows obtaining an electrophotographic photoconductor of high sensitivity and fast response, as well as high durability, that is used in high-resolution, high-speed electrophotographic apparatuses of positive charging schemes, such that the electrophotographic photoconductor boasts superior operational stability, and affords stably high image quality, without the occurrence of image defects due to cracks caused by sebum contamination, and in providing a method for producing the electrophotographic photoconductor, and obtaining an electrophotographic apparatus in which the electrophotographic photoconductor is used.

What is claimed is:

1. An electrophotographic photoconductor, comprising:

a conductive support; and a photoconductive layer that contains at least a charge generation material, a hole transport material, an electron transport material and a binder resin, and that is provided on the conductive support, wherein the photoconductive layer has an outermost layer that contains a charge generation material, a hole transport material, an electron transport material, a binder resin and a highly branched polymer that is obtained by polymerizing, in the presence of a polymerization initiator, a monomer having, in a molecule, two or more radically polymerizable double bonds and a monomer having, in a molecule, a long-chain alkyl group or an alicyclic group and at least one radically polymerizable double bond.

2. The electrophotographic photoconductor according to claim 1, wherein the highly branched polymer is obtained by polymerizing a monomer (A) and a monomer (B) in the presence of an azo-based polymerization initiator (C), the monomer (A) having, in a molecule, two or more radically polymerizable double bonds, and the monomer (B) having, in a molecule, an alkyl group having 6 to 30 carbon atoms or an alicyclic group having 3 to 30 carbon atoms, and at least one radically polymerizable double bond.

3. The electrophotographic photoconductor according to claim 2, wherein the monomer (A) has a structure represented by Formula (1) and the monomer (B) has a structure represented by Formula (2):

(1)

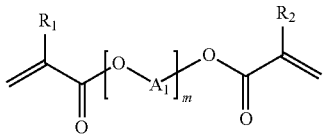

where, in Formula (1), $R_1$ and $R_2$ represent a hydrogen atom or a methyl group, $A_1$ represents an alicyclic group having 3 to 30 carbon atoms, or an alkylene group having 2 to 12 carbon atoms and optionally substituted with a hydroxy group, and m represents an integer ranging from 1 to 30, (2)

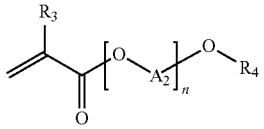

where, in Formula (2), $R_3$ represents a hydrogen atom or a methyl group, $R_4$ represents an alkyl group having 6 to 30 carbon atoms or an alicyclic group having 3 to 30 carbon atoms, $A_2$ represents an alkylene group having 2 to 6 carbon atoms, and n represents an integer ranging from 0 to 30.

4. The electrophotographic photoconductor according to claim 3, which is a single layer-type positively-chargeable photoconductor.

5. The electrophotographic photoconductor according to claim 3, which is a multilayer-type positively-chargeable photoconductor comprising at least a structure resulting from stacking a charge generation layer on a charge transport layer.

6. The electrophotographic photoconductor according to claim 5, which is a single layer-type positively-chargeable photoconductor.

7. The electrophotographic photoconductor according to claim 5, which is a multilayer-type positively-chargeable photoconductor comprising at least a structure resulting from stacking a charge generation layer on a charge transport layer.

8. The electrophotographic photoconductor according to claim 2, wherein the azo-based polymerization initiator (C) is 2,2'-azobis(2,4-dimethyl valeronitrile) or dimethyl 1,1'-azobis(1-cyclohexanecarboxylate).

9. The electrophotographic photoconductor according to claim 1, wherein the highly branched polymer has a polystyrene-equivalent molecular weight, as measured by gel permeation chromatography, that ranges from 1000 to 200000.

10. The electrophotographic photoconductor according to claim 9, which is a single layer-type positively-chargeable photoconductor.

11. The electrophotographic photoconductor according to claim 9, which is a multilayer-type positively-chargeable photoconductor comprising at least a structure resulting from stacking a charge generation layer on a charge transport layer.

12. The electrophotographic photoconductor according to claim 1, wherein the outermost layer contains 0.3 parts by mass to 6 parts by mass of the highly branched polymer with respect to 100 parts by mass of the binder resin in the outermost layer.

13. A method for producing an electrophotographic photoconductor according to claim 1, the method comprising:

providing a coating solution for the outermost layer that contains a charge generation material, a hole transport material, an electron transport material, a binder resin and a highly branched polymer having a long-chain alkyl group or an alicyclic group.

14. An electrophotographic apparatus, which is equipped with the electrophotographic photoconductor according to claim 1.

15. The electrophotographic apparatus according to claim 14, further comprising a charging device and a developing device.

* * * * *